US011566365B2

(12) United States Patent
Chae et al.

(10) Patent No.: US 11,566,365 B2
(45) Date of Patent: Jan. 31, 2023

(54) WASHING MACHINE

(71) Applicant: LG Electronics Inc., Seoul (KR)

(72) Inventors: Kyosoon Chae, Seoul (KR); Hyundong Kim, Seoul (KR); Sooyoung Oh, Seoul (KR); Jaeyong Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 237 days.

(21) Appl. No.: 16/845,935

(22) Filed: Apr. 10, 2020

(65) Prior Publication Data

US 2020/0325617 A1 Oct. 15, 2020

(30) Foreign Application Priority Data

Apr. 12, 2019 (KR) ..... 10-2019-0042791

(51) Int. Cl.
*D06F 39/02* (2006.01)
*D06F 33/37* (2020.01)
(Continued)

(52) U.S. Cl.
CPC ..... *D06F 39/022* (2013.01); *D06F 33/37* (2020.02); *D06F 2101/04* (2020.02); *D06F 2105/42* (2020.02)

(58) Field of Classification Search
CPC ..... D06F 39/022; D06F 2101/04; D06F 2105/42; D06F 33/37
See application file for complete search history.

(56) References Cited

U.S. PATENT DOCUMENTS 3,891,123 A * 6/1975 Blackburn ..... D06F 34/08 222/64
5,435,157 A * 7/1995 Laughlin ..... D06F 39/022 68/17 R
(Continued)

FOREIGN PATENT DOCUMENTS

CN 103290657 3/2016
DE 102009030329 1/2010
(Continued)

OTHER PUBLICATIONS

Office Action in European Appln. No. 20169343.9, dated Jul. 28, 2021, 4 pages.
(Continued)

*Primary Examiner* — Benjamin L Osterhout
(74) *Attorney, Agent, or Firm* — Fish & Richardson P.C.

(57) ABSTRACT

The present disclosure relates to a washing machine including a tub, a drum, and a detergent supply device configured to supply an additive to the tub. The detergent supply device includes a plurality of cartridges storing additive, a plurality of check valve assemblies connected to the plurality of cartridges and configured to control extracting of the additive, a pump for extracting additive, an inlet channel defining a plurality of flow paths respectively connected to the plurality of check valve assemblies, where the inlet channel is configured to transmit a pressure change generated by the pump to the plurality of check valve assemblies, and a flow path switching valve connected to the pump and the inlet channel and configured to selectively establish fluid communication between the pump and any one of the plurality of flow paths of the inlet channel.

15 Claims, 18 Drawing Sheets

(51) Int. Cl.
*D06F 101/04* (2020.01)
*D06F 105/42* (2020.01)

(56) References Cited

U.S. PATENT DOCUMENTS

| | | | | |
|---|---|---|---|---|
| 6,367,504 | B1 | 4/2002 | Knapp | |
| 6,434,772 | B1 * | 8/2002 | Barbe | D06F 33/37 68/17 R |
| 8,555,679 | B2 * | 10/2013 | Schulze | D06F 39/022 68/17 R |
| 9,109,710 | B2 * | 8/2015 | Hasse | D06F 39/022 |
| 2004/0098811 | A1 * | 5/2004 | Tuttle | D06F 39/022 68/3 R |
| 2005/0097925 | A1 * | 5/2005 | Kim | D06F 39/028 68/17 R |
| 2006/0206238 | A1 * | 9/2006 | Walker | D06F 33/37 700/283 |
| 2006/0272360 | A1 * | 12/2006 | Hsu | D06F 33/37 68/19 |
| 2008/0235880 | A1 * | 10/2008 | Kim | D06F 39/022 68/17 R |
| 2010/0088828 | A1 | 4/2010 | Kim et al. | |
| 2010/0161143 | A1 | 6/2010 | Smith et al. | |
| 2012/0018448 | A1 * | 1/2012 | Mehus | F04B 49/065 222/63 |
| 2012/0291916 | A1 | 11/2012 | Hwang | |
| 2013/0092704 | A1 * | 4/2013 | Tincher | D06F 39/02 417/474 |
| 2014/0096572 | A1 | 4/2014 | Kim et al. | |
| 2017/0107657 | A1 | 4/2017 | Kim et al. | |
| 2017/0191206 | A1 | 7/2017 | Jung et al. | |

FOREIGN PATENT DOCUMENTS

| | | |
|---|---|---|
| EP | 2521811 B1 | 3/2015 |
| JP | 2017080229 | 5/2017 |
| JP | 2018011618 | 1/2018 |
| KR | 1019990074113 | 10/1999 |
| KR | 1020090101679 | 9/2009 |
| KR | 1020110099288 | 9/2011 |
| KR | 1020130062271 | 6/2013 |
| WO | WO2014187119 | 11/2014 |
| WO | WO2015074688 | 5/2015 |
| WO | WO2017119593 | 7/2017 |

OTHER PUBLICATIONS

Extended European Search Report in European Application No. 20169343.9, dated Sep. 2, 2020, 6 pages.
PCT International Search Report in International Application No. PCT/KR2020/004937, dated Aug. 3, 2020, 4 pages.
Office Action in Chinese Appln. No. 202010286757.7, dated May 20, 2022, 17 pages (with English translation).

* cited by examiner

WASHING MACHINE

CROSS-REFERENCE TO RELATED APPLICATIONS

The present application claims priority under 35 U.S.C. 119 and 35 U.S.C. 365 to Korean Patent Application No. 10-2019-0042791, filed on Apr. 12, 2019, which is hereby incorporated by reference in its entirety.

TECHNICAL FIELD

The present disclosure relates to a washing machine, and more particularly, to a washing machine capable of automatically supplying various types of detergents.

BACKGROUND

A washing machine is an apparatus that can process laundry through various actions such as washing, dehydration and/or drying. A washing machine is an apparatus that removes contamination from laundry (hereinafter, also referred to as "clothes" or "clothing") by using water and detergent.

Recently, there has been an increasing demand for an automatic detergent supply device that automatically mixes and supplies various types of detergents to suit the clothing, and related technologies are being developed.

SUMMARY

The present disclosure provides a washing machine capable of supplying various liquid additive such as detergent stored in a plurality of cartridges by using a single pump.

The present disclosure further provides a washing machine having a small deviation between the amount of additive desired to be added and the amount of additive actually added.

The present disclosure further provides a washing machine that prevents mixing of different types of liquid additive.

According to one aspect of the subject matter described in this application, a washing machine includes: a tub configured to receive water; a drum rotatably provided in the tub and configured to accommodate laundry therein; and a detergent supply device configured to supply an additive to the tub. The detergent supply device includes: a plurality of cartridges configured to store the additive, a plurality of check valve assemblies connected to the plurality of cartridges and configured to control extracting of the additive from the plurality of cartridges, each of the check valve assemblies defining a space therein that is configured to receive the extracted additive, a pump configured to extract the additive by changing a pressure of the space in each of the plurality of check valve assemblies, an inlet channel defining a plurality of flow paths respectively connected to the plurality of check valve assemblies, the inlet channel being configured to transmit a pressure change generated by the pump to the space in each of the plurality of check valve assemblies, and a flow path switching valve connected to the pump and the inlet channel and configured to selectively establish fluid communication between the pump and any one of the plurality of flow paths of the inlet channel.

Implementations according to this aspect may include one or more of the following features. For example, the pump may include a cylinder and a piston that is configured to reciprocate within the cylinder. The flow path switching valve may be configured to selectively establish fluid communication between the cylinder and any one of the plurality of flow paths of the inlet channel. The piston may be configured to reciprocate within the cylinder along a direction parallel to a direction in which the plurality of cartridges are arranged. In some cases, the pump may include a motor that is configured provide power to the piston, and the motor may include a drive shaft that is oriented parallel to a direction along which the piston reciprocates within the cylinder.

In some implementations, the flow path switching valve may include: a first housing that is connected to the cylinder; a second housing that has a plurality of inlet connection ports respectively coupled to the plurality of flow paths of the inlet channel, that defines a plurality of flow path connection holes respectively in fluid communication with the plurality of inlet connection ports, and that is coupled with the first housing; a disk that is rotatably disposed in a space defined by the first housing and the second housing; and a spring valve provided at the disk and configured to selectively open and close at least a portion of the plurality of flow path connection holes. The spring valve may be provided in a smaller number than the plurality of flow path connection holes. In some cases, the washing machine according to this aspect may further include a controller configured to control operations of the detergent supply device, where the flow path switching valve includes: a flow path switching motor that is configured to rotate the disk, a shaft that is configured to transmit a rotational force of the flow path switching motor to the disk, a micro switch that is configured to input a rotational position of the disk to the controller, and a plane cam that rotates together with the shaft and is configured to and open and close a current path flowing through the micro switch.

In some implementations, the detergent supply device may include: a plurality of check valve connection pipes respectively connected to the plurality of check valve assemblies; and an outlet pipe that is configured to guide the additive extracted from the cartridge toward the tub. The check valve assembly may include a first check valve housing that defines a space configured to receive the additive extracted from the cartridge. In some cases, the first check valve housing may include an inlet connection portion that is coupled to any one flow path of the plurality of flow paths of the inlet channel and defines a hole that is in fluid communication with the any one flow path. In some cases, a first discharge hole connected to the cartridge may be defined in the first check valve housing, and the check valve assembly may include a first check valve that is configured to open and close the first discharge hole to thereby control the extracting of the additive from the cartridge to the space in the first check valve housing.

In some implementations, the detergent supply device may include: a plurality of check valve connection pipes respectively connected to the plurality of check valve assembly; and an outlet pipe that is configured to guide the additive extracted from the cartridge toward the tub. Here, the check valve assembly may include: a second check valve housing that defines a second discharge hole in fluid communication with the space of the first check valve housing and that is connected to the check valve connection pipe, and a second check valve that is configured to open and close the second discharge hole and to control the extracting of the additive from the space of the first check valve housing into the second check valve housing. In some cases, the first check valve may be located in the first check valve housing and is configured to open and close the first discharge hole, and the second check valve may be located in the second check valve housing and is configured to open and close the second discharge hole.

In some cases, when the piston is moving within the cylinder in a forward direction toward an inlet channel side, the first check valve may be configured to close the first discharge hole and the second check valve is configured to open the second discharge hole, and when the piston moving within the cylinder in a rearward direction to an opposite side of the inlet channel, the first check valve may be configured to open the first discharge hole and the second check valve may be configured to close the second discharge hole.

DETAILED DESCRIPTION

Hereinafter, exemplary implementations will be described with reference to the accompanying drawings. The disclosure may, however, be implemented in many different forms and should not be construed as being limited to the implementations set forth herein.

Figure 1:
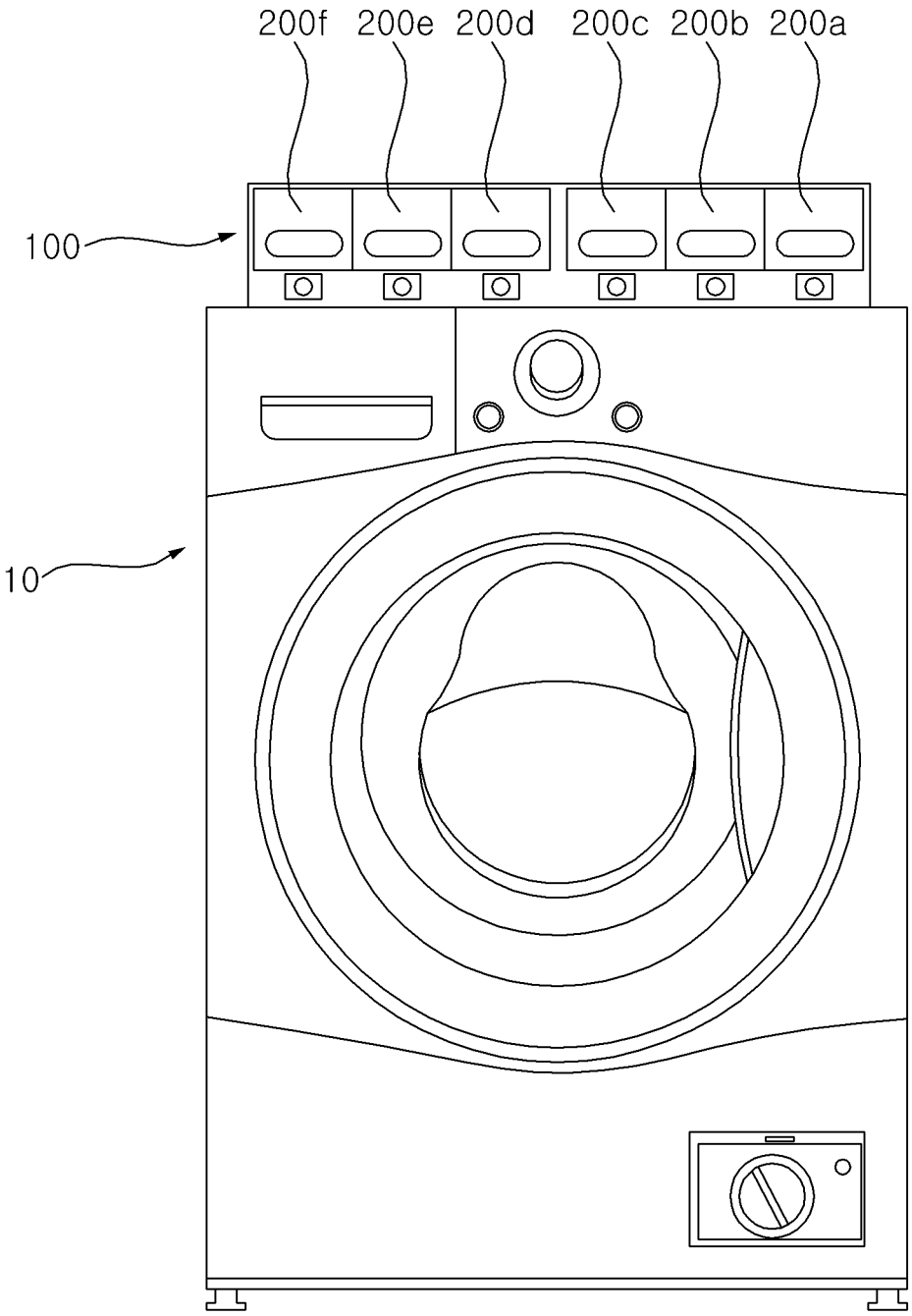
FIG. 1 is a front view of an example washing machine.
Figure 2:
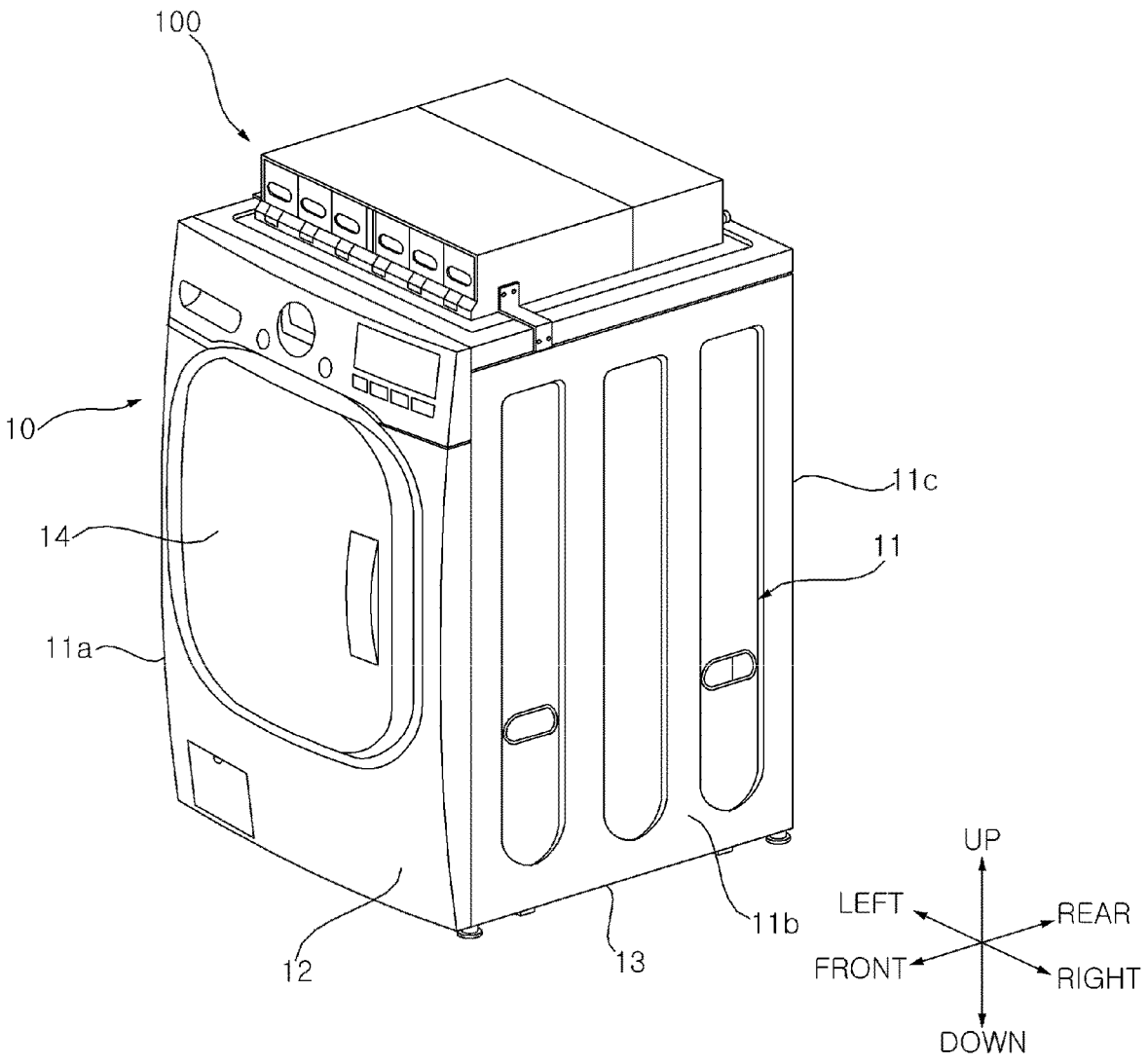
FIG. 2 is a perspective view of the example washing machine.
Figure 3:
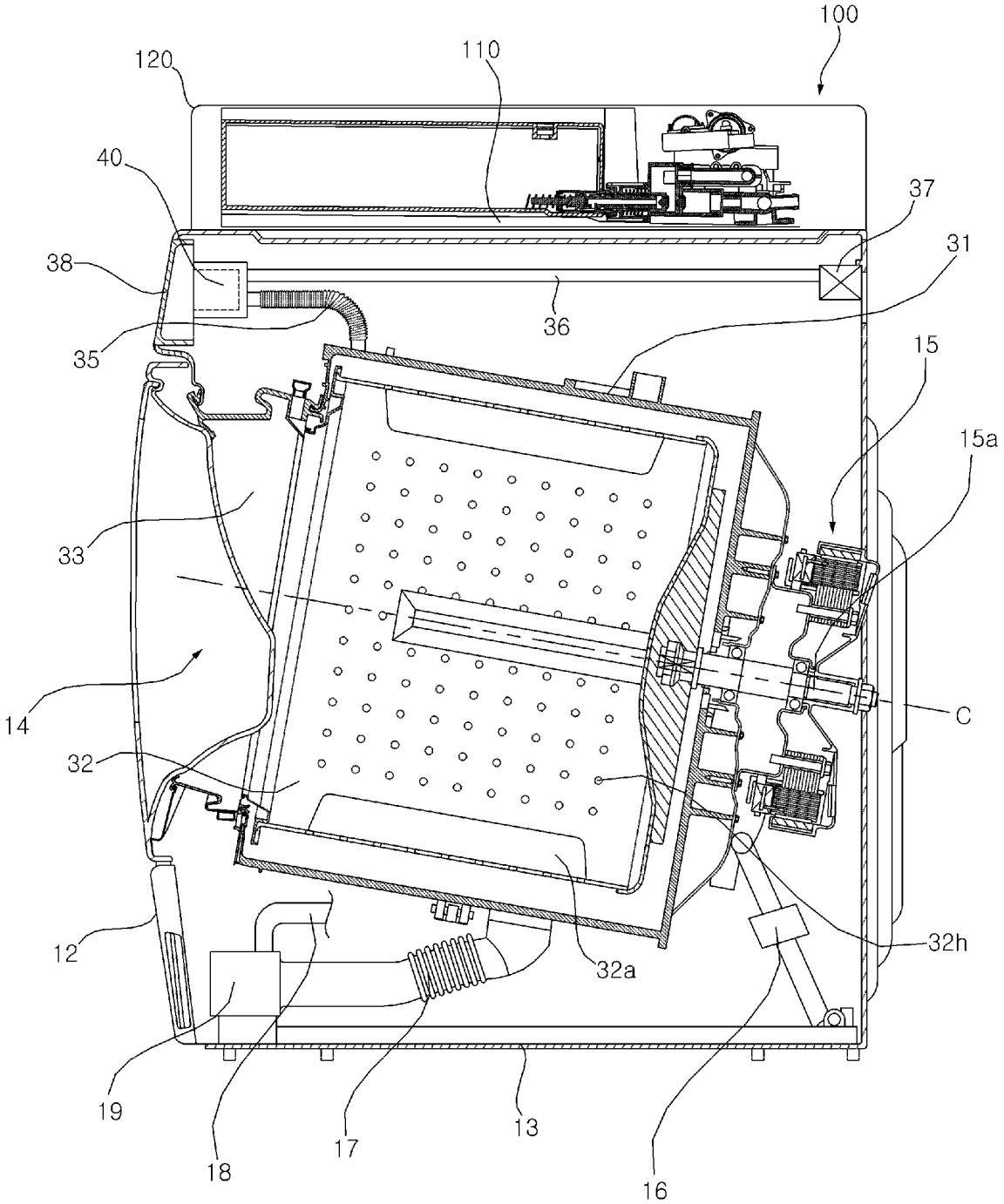
FIG. 3 is a side cross-sectional view of the example washing machine.

Referring to FIGS. 1 to 3, a washing machine according to an implementation of the present disclosure includes a tub 31 in which water is stored, a drum 32 which is rotatably provided in the tub 31 and receives laundry, and a detergent supply device for supplying a detergent, a fabric softener, a bleaching agent, and the like (hereinafter, also referred to as "additive") to the tub 31. In addition, the washing machine includes a cabinet 10 in which the tub 31 and the drum 32 are accommodated, and a detergent supply device 100 may be installed in the upper surface of the cabinet 10 separately from a washing machine body, or may be integrally installed with the washing machine body in the inside of the cabinet 10. Hereinafter, a case where the detergent supply device 100 is installed separately from the washing machine body will be described as an example.

The cabinet 10 forms an outer shape of the washing machine, and the tub 31 and the drum 32 are accommodated therein. The cabinet 10 includes a main frame 11 having a front surface that is open and having a left side surface 11*a*, a right side surface 11*b*, and a rear side surface 11*c*, a front panel 12 which is coupled to the open front surface of the main frame 11 and in which a loading port is formed, and a horizontal base 13 supporting the main frame 11 and the front panel 12 from the lower side. The door 14 for opening and closing the loading port is rotatably coupled to the front panel 12.

The front panel 12 and the tub 31 are communicated by an annular gasket 33. The front end portion of the gasket 33 is fixed to the front panel 12, and the rear end portion is fixed around an inlet of the tub 31. The gasket 33 may be formed of a material having elasticity, and is designed to prevent water in the tub 31 from leaking.

A driving unit 15 is located on the rear side of the drum 32 to rotate the drum 32. In addition, a water supply hose for guiding water supplied from an external water source, and a water supply unit 37 for controlling water supplied through the water supply hose to be supplied to a water supply pipe 36 may be provided. The water supply unit 37 may include a water supply valve that controls the water supply pipe 36.

The cabinet 10 may include a drawer 38 for receiving detergent and a drawer housing 40 in which the drawer 38 is retractably accommodated. The detergent may include, for example, bleach or fabric softener as well as laundry detergent. The detergent accommodated in the drawer 38 is supplied to the tub 31 through a water supply bellows 35 when water is supplied through the water supply pipe 36. A water supply port connected to the water supply bellows 35 may be formed in the side surface of the tub 31.

A drain hole for discharging water may be provided in the tub 31, and a drain bellows 17 may be connected to the drain hole. A drain pump 19 is provided to pump and discharge the water discharged from the tub 31 through the drain bellows 17 to the outside of the washing machine.

Referring to FIGS. 5 to 8, the detergent supply device 100 may include a plurality of cartridges 200*a*, 200*b*, 200*c*, 200*d*, 200*e*, 200*f* (hereinafter, 200) containing the additive respectively, a plurality of check valve assemblies 400*a*, 400*b*, 400*c*, 400*d*, 400*e*, 400*f* (hereinafter, 400) connected to the plurality of cartridges 200 respectively to control the extracting of the additive, a pump 500 for drawing the additive from the cartridge 200 to the check valve assembly 400, an inlet flow path 700 which is provided with a plurality of flow paths 700*a*, 700*b*, 700*c*, 700*d*, 700*e*, 700*f* that are respectively connected to the plurality of check valve assemblies 400, and transmits a pressure change generated by the pump 500 to the check valve assembly 400, and a flow switching valve 600 which is connected to the pump 500 and the inlet flow path 700 and allows the pump 500 to selectively communicate with any one (e.g. 700*a*) of the plurality of flow paths 700*a*, 700*b*, 700*c*, 700*d*, 700*e*, 700*f* of the inlet flow path 700. In addition, the detergent supply device 100 may include an electrode sensor 300 for detecting the amount of the additive accommodated in the cartridge 200, a water supply valve 830 receiving water from an external water source, and an outlet pipe 800 through which the water supplied from the water supply valve 830 and an additive extracted from the cartridge 200 flow.

In the check valve assembly 400, a space S2 in which the extracted additive is temporarily stored may be formed, and the pump 500 can subsequently extract the additive from the plurality of cartridges by changing the pressure in the space. The outlet pipe 800 may be provided with a plurality of check valve connection pipes 850*a*, 850*b*, 850*c*, 850*d*, 850*e*, 850*f* (hereinafter, 850) which are respectively connected to a plurality of check valve assemblies to allow the extracted additive to be discharged to the outlet pipe 800. In some cases, the extracted additive may be temporarily stored in the manner described above for a few seconds.

The detergent supply device 100 may include a housing 110 having a front surface in which an inlet is formed and having an accommodation space defined therein, and a cover 120 that opens and closes the housing 110.

A plurality of openings having a rectangular parallelepiped shape may be formed in the front side of the housing 110, where each opening extends to the rear of the housing 110 to form a cartridge accommodating space for each opening. Accordingly, a plurality of cartridges 200 may be inserted into the respective opening spaces through the front opening.

Each cartridge 200 contains additive, for example, additives of different composition, such as general laundry detergent, wool detergent, baby clothes detergent, outdoor clothes detergent, bleach, and fabric softener. The additive may be a liquid additive.

The cartridge 200 according to one implementation of the present disclosure includes six cartridges, but the number is not necessarily limited thereto. Preferably, three or more cartridges may be provided.

In the rear space of the cartridge 200 accommodating space, an accommodating space in which detergent supply part such as the flow path 700 and 800, the flow path switching valve 600, and the pump 500 are installed may be formed. Between the cartridge accommodating space and a rear side part accommodating space, a rear wall 111*a*, 111*b*, 111*c*, 111*d*, 111*e*, 111*f* (hereinafter, 111) is installed, and an electrode sensor 300 including a terminal and an electrode plate described later is installed in the rear wall.

Figure 4:
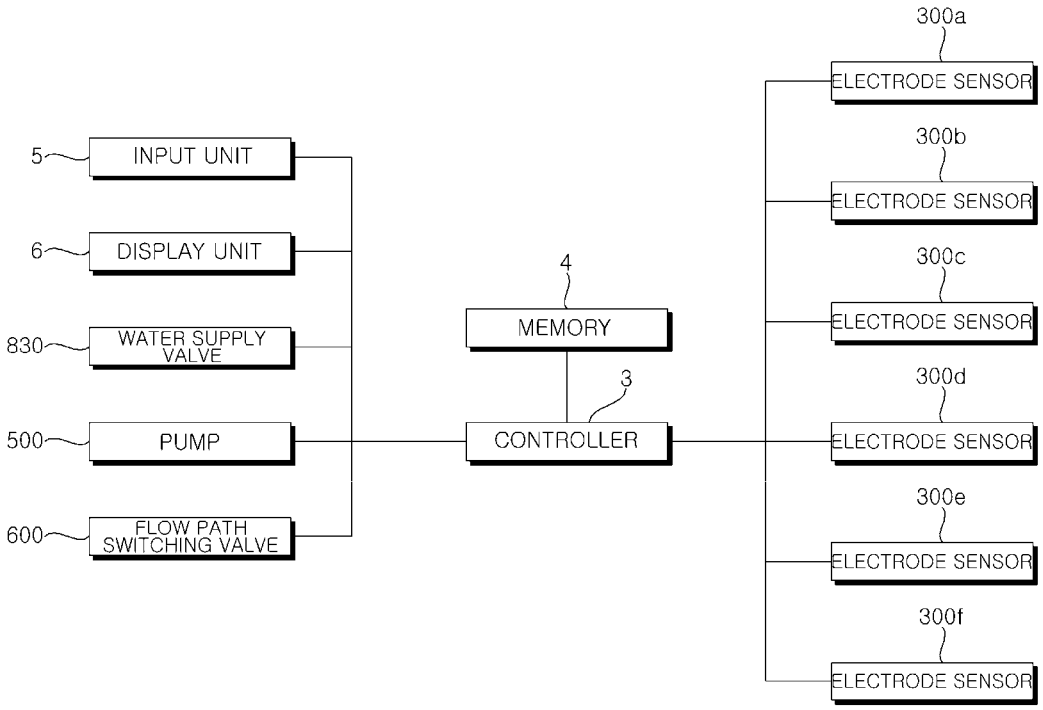
FIG. 4 is a block diagram showing an example controller of washing machine.
Figure 5:
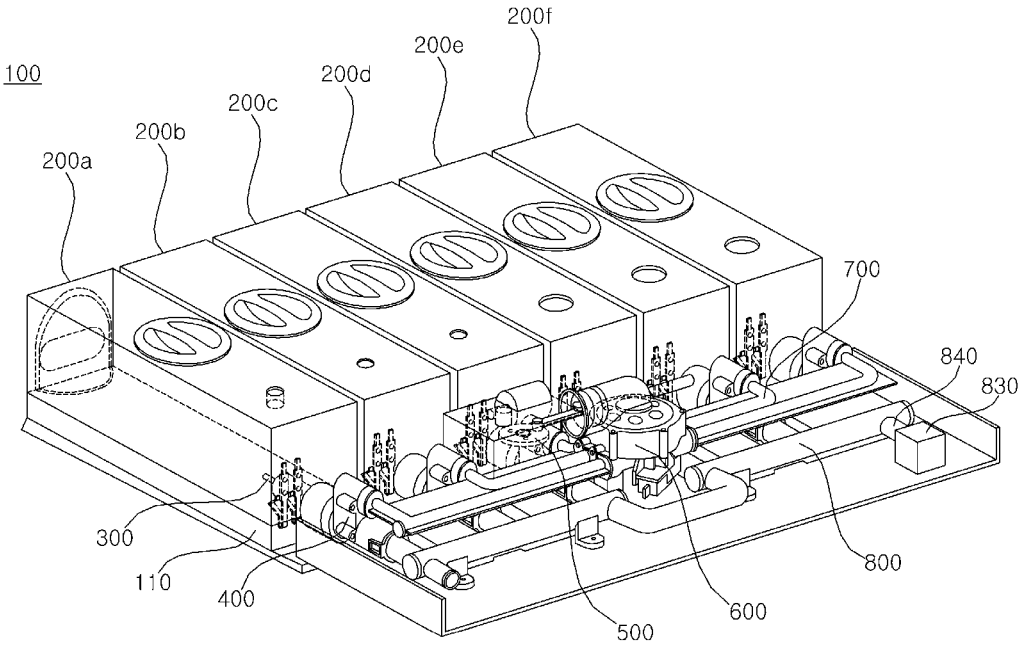
FIG. 5 is a perspective view of an example detergent supply device of the washing machine.
Figure 6:
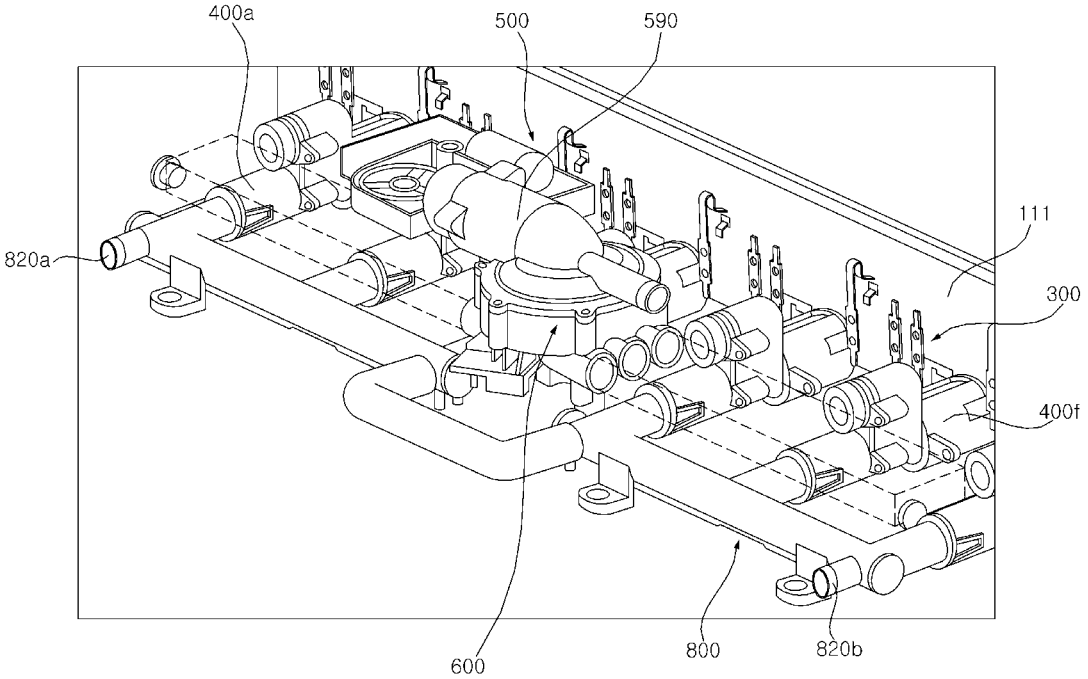
FIG. 6 is a perspective view of another angle of the detergent supply device shown in FIG. 5.
Figure 7:
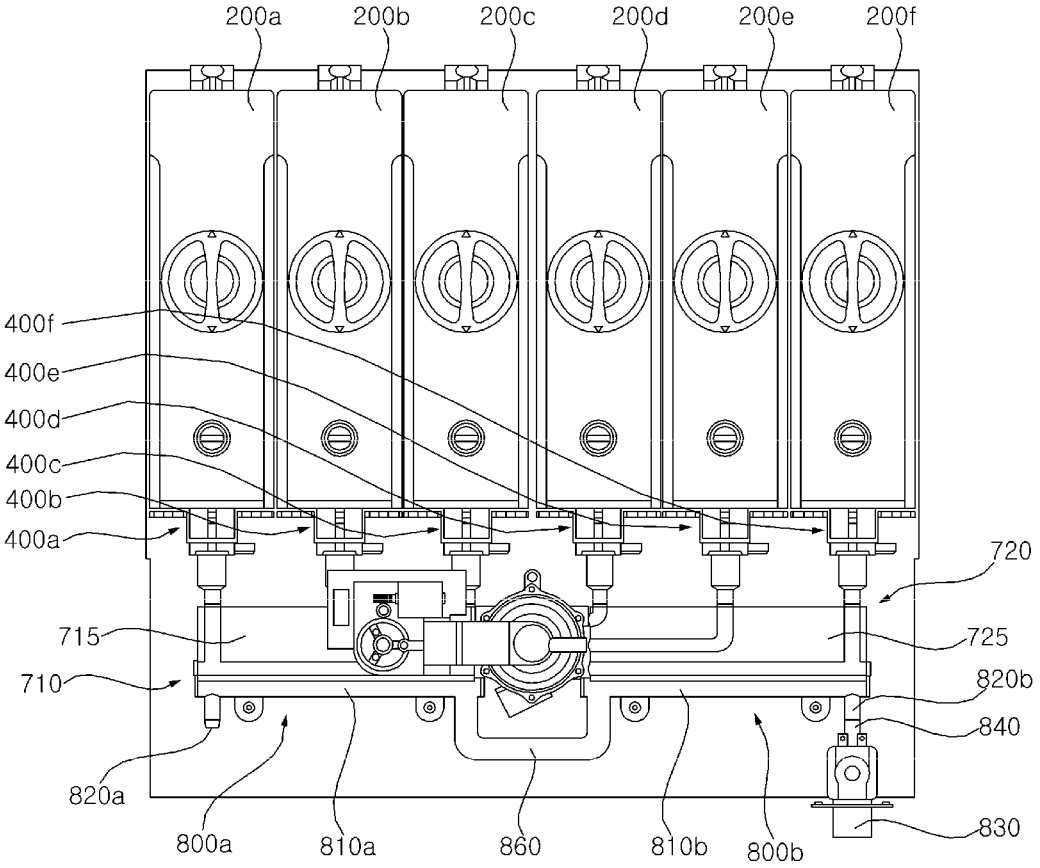
FIG. 7 is a plan view of an example washing machine according to one implementation of the present disclosure.

Referring to FIG. 4, the detergent supply device 100 may include a controller 3 for controlling the pump 500, the flow path switching valve 600, and the like. The controller 3 may be installed in the main body of the washing machine, or separately installed in the detergent supply device 100 to exchange information with a controller installed in the main body of the washing machine.

In some cases, the controller 3 may include at least one of an electric circuit, one or more processors, a non-transitory memory, or a communication device.

The pump 500 and the flow path switching valve 600 may be controlled by the controller 3. Information related to additive, such as components constituting the additive and composition ratio of the components, may be stored in a memory 4. Each cartridge 200 accommodates any one of the above components, and the controller 3 can control the pump 500 and the flow path switching valve 600 based on additive information stored in the memory 4.

The washing machine may further include an input unit 5 that receives various control commands for the operation of the washing machine from a user. The input unit 5 may be provided in an upper portion of the front panel 12. The front panel 12 may be further provided with a display unit 6 for displaying the operating state of the washing machine.

According to the setting input by the user through the input unit 5, the controller 3 may select an additive type from the memory 4 and check corresponding additive information. Then, the controller 3 may control the operation of the pump 500 and the flow path switching valve 600 to form the additive selected in this way. That is, it is possible to control the operation of the pump 500 and the flow path switching valve 600 corresponding to the cartridge 200 accommodating the additive according to the additive that make up the selected additive and the composition ratio of the additive.

Hereinafter, the cartridge 200 and the electrode sensor 300 will be described with reference to FIGS. 3 and 5 to 11.

The cartridge 200 may include a cartridge body 210*a*, 210*b*, 210*c*, 210*d*, 210*e*, 210*f* (hereinafter, 210) forming a main body and storing the additive, a first opening 211*a*, 211*b*, 211*c*, 211*d*, 211*e*, 211*f* (hereinafter, 211) into which the additive can be added to the cartridge body 210, a cap 220*a*, 220*b*, 220*c*, 220*d*, 220*e*, 220*f* (hereinafter, 220) that can open and close the first opening, a membrane 230*a*, 230*b*, 230*c*, 230*d*, 230*e*, 230*f* (hereinafter, 230) which passes air inside and outside the cartridge 200, a second opening 213*a*, 213*b*, 213*c*, 213*d*, 213*e*, 213*f* (hereinafter, 213) in which the membrane 230 is installed, a cartridge locker 240*a*, 240*b*, 240*c*, 240*d*, 240*e*, 240*f* (hereinafter, 240) to allow the cartridge 200 to be fixed to the housing 110 when the cartridge 200 is inserted into the housing 110, a docking valve 250*a*, 250*b*, 250*c*, 250*d*, 250*e*, 250*f* (hereinafter, 250) connecting the check valve assembly 400 and the cartridge 200, and a rib 260*a*, 260*b*, 260*c*, 260*d*, 260*e*, 260*f* (hereinafter, 260) that prevent additive from contacting the membrane 230. In some cases, the cartridge 200 may be disposable.

The cartridge body 210 is formed to correspond to the shape of the housing 110 so as to be inserted and coupled to the cartridge accommodating space formed in the front side of the housing 110. According to an implementation of the present disclosure, a cartridge accommodating portion 110*a*, 110*b*, 110*c*, 110*d*, 110*e*, 110*f* (hereinafter 110) of the housing 110 is formed in the shape of a rectangular parallelepiped, the cartridge 200 is also formed in a corresponding rectangular parallelepiped, but the edge may be formed to be rounded to minimize wear when the cartridge 200 is detached.

The cartridge body 210 can have a docking valve insertion hole formed in one surface thereof, and the docking valve 250 may be inserted into the insertion hole and installed in the cartridge body 210. The docking valve insertion hole may be formed in the rear surface of the cartridge body 210. The insertion hole may be formed below the rear surface so that additive can flow out to the check valve assembly 400 through the docking valve 250 even when a small amount of additive is contained in the cartridge.

For the above reasons, the cartridge 200 may be installed to be inclined downward toward the rear. In more detail, the cartridge 200 may be disposed such that the bottom surface inside the cartridge body 210 is inclined downward toward the direction in which the insertion hole is formed. When the insertion hole is formed in the rear surface of the cartridge body 210, the cartridge 200 may be disposed such that the bottom surface inside the cartridge body 210 is inclined downward toward the rear side.

Figure 11A:
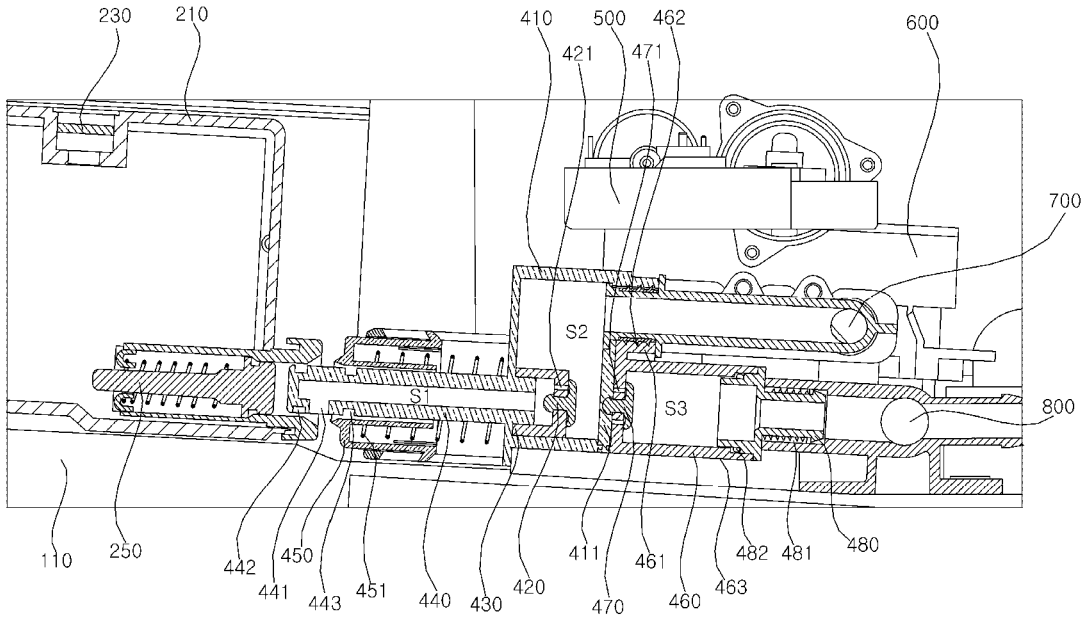
FIGS. 11A and 11B are cross-sectional views illustrating engaged and disengaged states, respectively, of a cartridge and a check valve assembly shown in FIG. 8.
Figure 11B:
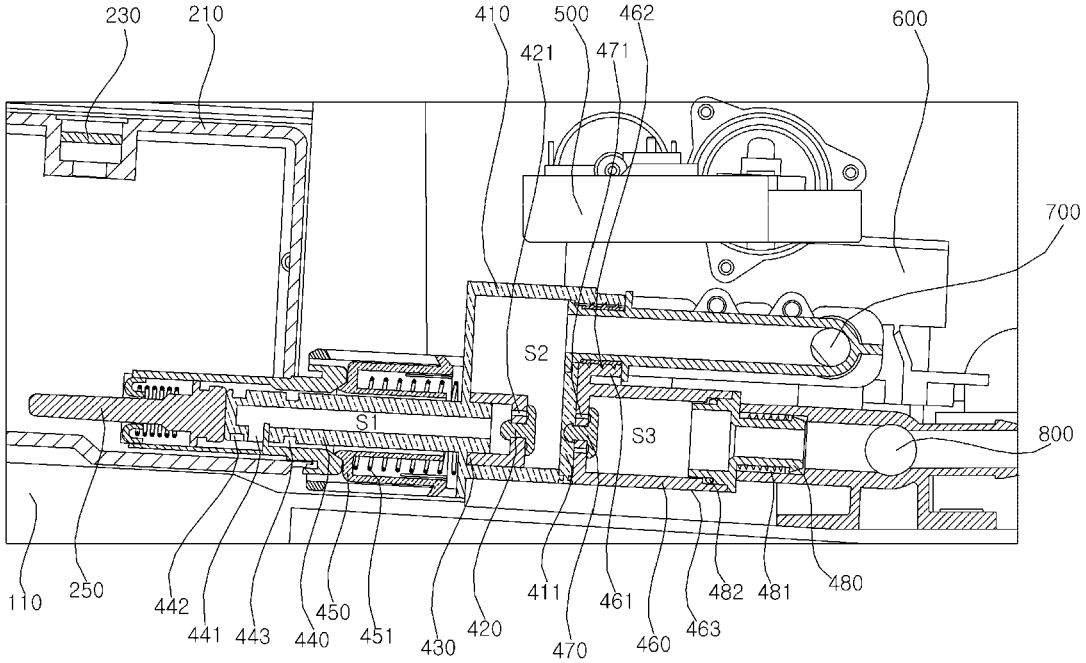

FIG. 11A shows a state in which the cartridge 200 is detached from the cartridge accommodating space of the housing 110 and the docking valve 250 and a docking pipe 440 are disengaged, and FIG. 11B shows a state in which the cartridge 200 is inserted into the cartridge accommodating space of the housing 110 and the docking valve 250 and the docking pipe 440 are coupled.

The docking valve 250 includes a docking valve housing installed in the cartridge 200, a docking valve plug installed inside the docking valve housing, a docking valve shaft that supports the docking valve plug, and a docking valve spring surrounding the docking valve shaft.

When the cartridge 200 deviates from the cartridge accommodating space of the housing 110, the docking valve plug retracts to the rear side by the restoring force of the docking valve spring, and the docking valve 250 is closed. Therefore, even if the cartridge 200 escapes from the accommodating space in the state in which the additive is contained, the additive does not leak.

When the cartridge 200 is inserted into the cartridge accommodating space of the housing 110, the docking valve plug is pushed by the docking pipe 440 to move forward, and the docking valve 250 is opened. When the cartridge 200 is inserted into the cartridge accommodating space, the elastic force of the docking valve spring and the docking pipe spring 451 described later acts on the cartridge 200, but the cartridge 200 can be fixed by the cartridge locker 240 described above. When the docking valve 250 is opened, the additive contained in the cartridge 200 flows into a docking pipe inner space S1 through a detergent inlet 441.

When the cartridge locker 240 is unlocked, the cartridge 200 is released forward by the docking valve spring and the docking pipe spring 451. Therefore, the user can easily separate the cartridge 200 from the cartridge housing 110.

In some cases, the electrode sensor 300 may be installed on the rear wall 111 formed as the housing 110 on the rear side of the inserted cartridge 200. More specifically, an electrode plate 321, 322, 323, 324, 325, 326 (hereinafter, 321) is installed between the rear wall and the cartridge body 210. A terminal 311, 312, 313, 314, 315, 316 (hereinafter, 311) is installed in a rear wall protrusion portion 111*a*1, 111*b*1, 111*c*1, 111*d*1, 111*e*1, 111*f*1, (hereinafter, 111*a*1) protruding from the rear wall to the rear side of the detergent supply device. The terminal is provided with a protrusion portion (311-1, 312-1, 313-1, 314-1, 315-1, 316-1, hereinafter 311-1) having a forward curvature, and the protrusion portion may push the electrode plate toward the cartridge and, at the same time, be in contact with the electrode plate to receive an electrical signal from the electrode plate.

The electrode plate 321 is connected with the terminal 311 by a rear wall electrode plate opening 112-1, 112-2, 112-3, 112-4, 112-5, 112-6 (hereinafter, 112-1), in contact with the inside of the cartridge by a cartridge electrode plate opening (216-1, 216-2, 216-3, 216-4, 216-5, 216-6 (hereinafter, 216-1), in contact with the additive contained in the cartridge, in the front side, to flow the current, and may transmit an electrical signal to the controller 3 through the terminal in the rear side.

According to an implementation of the present disclosure, three terminals and three electrode plates are provided for each cartridge. A first terminal 311*a*, 312*a*, 313*a*, 314*a*, 315*a*, 316*a* (hereinafter, 311*a*) and a first electrode plate 321*a*, 322*a*, 323*a*, 324*a*, 325*a*, 326*a* (hereinafter, 321*a*), and a second terminal 311*b*, 312*b*, 313*b*, 314*b*, 315*b*, 316*b* (hereinafter, 311*b*) and a second electrode plate 321*b*, 322*b*, 323*b*, 324*b*, 325*b*, 326*b* (hereinafter, 321*b*) are provided in one side based on the lower side of the cartridge and the docking valve 250*a*, 250*b*, 250*c*, 250*d*, 250*e*, 250*f* (hereinafter, 250).

A third terminal 311*c*, 312*c*, 313*c*, 314*c*, 315*c*, 316*c* (hereinafter, 311*c*) and a third electrode plate 321*c*, 322*c*, 323*c*, 324*c*, 325*c*, 326*c* (hereinafter, 321*c*) are provided in the other side based on the upper side of the cartridge and the docking valve 250.

The electrode sensor 300 outputs a signal when two electrodes of positive (+) and negative (−), spaced apart from each other, are conducted through a medium. Therefore, when the additive is sufficiently contained in the cartridge, the additive acts as a medium to allow current to flow, and the terminal detects this flow of current to detect the amount of the additive inside the cartridge.

When only two electrode plates 321 and two terminals 311 of the electrode sensor 300 are installed for each cartridge, the amount of additive may be incorrectly detected due to the reason that the cartridge is shaken or the additive is hardened around the electrode sensor.

According to an implementation of the present disclosure, the first and second electrode plates 321*a* and 321*b* are formed of different electrodes, respectively, and are installed below the cartridge 200, and the third electrode plate 321*c* is installed above the cartridge 200*a*. Thus, a first signal may be generated when first and second electrode plates are electrically conducted to each other, and a second signal may be generated when the first or second electrode plate and the third electrode plate are electrically conducted. Accordingly, it is possible to detect the additive amount of the cartridge by synthesizing the first and second signals and, furthermore, to determine whether the electrode sensor is failed or not installed.

More specifically, if both the first and second signals are not detected, it can be determined that the cartridge is almost empty or not installed, and if only the second signal is detected, it can be determined that the electrode sensor is failed or has a contact failure. When only the first signal is detected, it can be determined that the amount of the additive is insufficient, and when both the first and second signals are detected, it can be determined that the cartridge contains sufficient additive.

The determination result through the first and second signals may be displayed through a display unit 6 so that the user can easily recognize the determination result. In some cases, in one implementation of the present disclosure, the first and second electrode plates are provided in a lower side, and the third electrode plate is installed in an upper side, but the present disclosure is not limited thereto, and it is enough that at least three electrode plates having different heights are provided to minimize the case where the amount of additive is detected incorrectly.

According to an implementation of the present disclosure, the shapes of the first and second electrode plates 321*a* and 321*b* have an angled shape, for example an "L" shape, rather than a general square shape. This can minimize the interference between the first and second electrode plates by making the width of the lower portion of the electrode plate with which the additive is in contact, because the signal due to conduction may be incorrectly detected by the interference between the electrodes if the two electrodes are too close together. However, the shape of the electrode plate is not limited to the L-shape, and any shape that can minimize interference between the two electrodes may be used.

Hereinafter, the structure of the check valve assembly 400 will be described with reference to FIGS. 5 to 8 and 11.

The plurality of check valve assemblies 400 are respectively connected to the plurality of cartridges 200 to control the extracting of the additive. In the check valve assembly 400, a space S2 in which the extracted additive is temporarily stored is formed. In the space S2 formed in the check valve assembly 400, the pressure from the pump 500 is changed, and thus, the additive contained in the cartridge is extracted to the space S2.

The check valve assembly 400 may include a first check valve housing 410*a*, 410*b*, 410*c*, 410*d*, 410*e*, 410*f* (hereinafter, 410) which forms a space S2 in which the additive extracted from the cartridge 200 is temporarily stored, a first check valve installed in the first check valve housing 420*a*, 420*b*, 420*c*, 420*d*, 420*e*, 420*f* (hereinafter, 420), a second check valve housing 460*a*, 460*b*, 460*c*, 460*d*, 460*e*, 460*f* (hereinafter, 460) which is in communication with the first check valve housing 410 and connected to each of a plurality of check valve connection pipes 850 provided in an outlet pipe 800, and a second check valve 470 installed in the second check valve housing 460.

In addition, the check valve assembly 400 may include a check valve cap 430*a*, 430*b*, 430*c*, 430*d*, 430*e*, 430*f* (hereinafter, 430) that can help prevent additive and air from leaking through the first check valve 420, and a docking pipe 440*a*, 440*b*, 440*c*, 440*d*, 440*e*, 440*f* (hereinafter, 440) which is coupled to the docking valve 250 of the cartridge 200 and can move the additive of the cartridge 200 in the direction of the check valve.

A first discharge hole 421 communicating with the cartridge 200 may be formed in the first check valve housing 410. The space S2 inside the first check valve housing 410 communicates with the cartridge 200 by a space S1 formed in a docking pipe described later and the first discharge hole 421.

The first check valve 420 opens and closes the first discharge hole 421 to control the extracting of the additive from the cartridge 200 to the space S2 of the first check valve housing. When the first check valve 420 is separated from the peripheral portion of the first discharge hole 421 of the first check valve housing 410 to open the first discharge hole 421, the additive contained in the cartridge 200 is extracted to the space S2 of the first check valve housing. When the first check valve 420 is in contact with the peripheral portion of the first discharge hole 421 of the first check valve housing 410 to close the first discharge hole 421, the additive contained in the cartridge 200 is not extracted to the space S2 of the first check valve housing.

The first check valve housing 410 may include an inlet connection portion 461*a*, 461*b*, 461*c*, 461*d*, 461*e*, 461*f* (hereinafter, 461) connected to an inlet flow path. The inlet connection portion 461 can be tightly coupled to an inlet flow path 700 through an inlet connection plug 462*a*, 462*b*, 462*c*, 462*d*, 462*e*, 462*f* (hereinafter, 462). The plurality of check valve assemblies 400 are respectively connected to the plurality of flow paths 700*a*, 700*b*, 700*c*, 700*d*, 700*e*, 700*f* of the inlet flow path 700 described later through the inlet connection portion 461.

In some cases, in the first check valve housing 410, the opposite side where the first discharge hole is formed is open, the second check valve housing 460 having the inlet connection portion 461 is coupled to the opened portion, so that the check valve assembly 400 and the inlet flow path 700 may be connected.

The docking pipe 440 is provided with a detergent inlet 441*a*, 441*b*, 441*c*, 441*d*, 441*e*, 441*f* (hereinafter 441) into which additive supplied from the cartridge 200 flows through the docking valve 250, a flow path (hereinafter, also referred to as a space S1) communicating with the detergent inlet 441 is formed inside the docking pipe 440.

Referring to FIG. 11A and FIG. 11B, when the cartridge 200 is inserted into the cartridge accommodating space of the housing 110, the docking valve 250 is opened so that the additive contained in the cartridge 200 flows into the inner space S1 of the docking pipe through the detergent inlet 441.

The check valve assembly 400 may include docking pipe circumferential portion 450*a*, 450*b*, 450*c*, 450*d*, 450*e*, 450*f* (hereinafter, 450) coupled to the docking valve 250, around the docking pipe. The front surface of the docking pipe circumferential portion 450 and the rear surface of the docking valve housing forming an outer shape of the docking valve 250 may be formed in an interlocking shape. In addition, a docking pipe spring 451*a*, 451*b*, 451*c*, 451*d*, 451*e*, 451*f* (hereinafter, 451) may be installed in the docking pipe circumferential portion 450. Accordingly, the check valve assembly 400 and the docking valve 250 may be firmly coupled through the spring of the docking valve 250 and the elastic force of the docking pipe spring 451.

In the docking pipe 440 where the detergent inlet is interposed, a first docking pipe O-ring 442*a*, 442*b*, 442*c*, 442*d*, 442*e*, 442*f* (hereinafter, 442) and a second docking pipe O-ring 443*a*, 443*b*, 443*c*, 443*d*, 443*e*, 443*f* (hereinafter, 443) are inserted into and installed in a first docking pipe O-ring groove 442*a*-1, 442*b*-1, 442*c*-1, 442*d*-1, 442*e*-1, 442*f*-1 (hereinafter, 442-1) and a second docking pipe O-ring groove 443*a*-1, 443*b*-1, 443*c*-1, 443*d*-1, 443*e*-1, 443*f*-1 (hereinafter, 443-1). This is to prevent the additive from leaking outside when the additive enters the detergent inlet.

Between the first check valve housing 410 and the second check valve housing 460, a check valve o-ring 411*a*, 411*b*, 411*c*, 411*d*, 411*e*, 411*f* (hereinafter, 411) is inserted and install so that the first check valve housing 410 and the second check valve housing 460 are connected and, at the same time, sealed to help prevent air from leaking. Alternatively, the first check valve housing 410 and the second check valve housing 460 may be integrally formed.

The second check valve housing 460 is provided with a second discharge hole 471 communicating with the space S2 of the first check valve housing. The second check valve housing 460 is coupled to an outlet connection pipe 480 to form a space S3 therein.

The outlet connection pipe 480 may be integrally formed with the second check valve housing 460, or separately provided to be coupled to the second check valve housing. The outlet connection pipe 480 is coupled to a check valve connection pipe 850 of the outlet pipe 800 to communicate the space S3 of the second check valve housing 460 with the outlet pipe 800.

The outlet connection pipe 480 is coupled to an outlet connection portion 463 formed in a distal end of the second check valve housing 460, and is firmly coupled to the second check valve housing 460 by the outlet connection O-ring 482*a*, 482*b*, 482*c*, 482*d*, 482*e*, 482*f* (hereinafter, 482). The outlet connection pipe is tightly coupled to the check valve connection pipe 850 of the outlet pipe 800 by the outlet connection plug 481*a*, 481*b*, 481*c*, 481*d*, 481*e*, 481*f* (hereinafter, 481).

The second check valve 470 opens and closes the second discharge hole 471 to control of the discharge of the additive from the space S2 of the first check valve housing to the space S3 of the second check valve housing. When the second check valve 470 is separated from the peripheral portion of the second discharge hole 471 of the second check valve housing 460 to open the second discharge hole 471, the additive temporarily stored in the space S2 of the first check valve housing can be discharged to the space S3 of the second check valve housing. When the second check valve 470 contacts the peripheral portion of the second discharge hole 471 of the second check valve housing 460 and closes the second discharge hole 471, the additive temporarily stored in the space S2 of the first check valve housing is not discharged into the space S3 of the second check valve housing.

The first check valve 420 may be disposed to open the first discharge hole 421, in the inside S2 of the first check valve housing 410, and the second check valve 470 may be disposed to open and close the second discharge hole 471, in the inside S3 of the second check valve housing 460. The first check valve 420 and the second check valve 470 may be installed to be opened in the same direction.

This is because when two check valves are installed to be opened in different directions, it is impossible to form a negative pressure in the second space S2 so as to extract the additive. Among the first check valve 420 and the second check valve 470 according to the implementation of the present disclosure, it is possible that the first check valve 420 is opened only to the second space S2, and the second check valve 470 is opened only to the third space S3.

The first and second check valves 420 and 470 may have a circular hemispherical shape and use an elastic rubber material. One end of the first and second check valves 420 and 470 is formed of a protrusion portion 423, 473 to be fitted into the first and second discharge holes 422 and 472 formed in the center of the first and second discharge holes 421 and 471. The other end of the first and second check valves 420 and 470 is formed of a hemisphere portion 424 and 474 having a hemispherical shape, so that a flat surface of the hemisphere portion may be seated in the first and second discharge surfaces 425 and 475 where the first and second discharge holes 421 and 471 are formed.

The distal end of the protrusion portion 423 and 473 is formed to be thicker than the middle, and the distal end of the protrusion portion 423 and 473 is caught in the rear surface of the first and second discharge holes 422 and 472 so that the first and second check valves 420, 470 are fixed to the first and second discharge holes 421 and 471.

When the pressure of the fluid through a piston 580 described later is transmitted in the direction of the hemisphere portion 424 and 474 of the first and second check valves 420 and 470, the flat portion of the hemisphere portion 424 and 474 is in close contact with the first and second discharge holes 421 and 471 that are in contact with each other due to the pressure of the fluid, thereby closing the first and second discharge holes. Therefore, the additive may be prevented from entering the inlet channel 700 or outlet pipe 700, 800 through the closed first and second discharge holes.

In some cases, when the pressure of the fluid through the piston 580 is transmitted in the direction of the protrusion portion 423 and 473 of the first and second check valves 420 and 470, the flat portion of the hemisphere portion 424 and 474 is separated from the first and second discharge holes 421 and 471 that are in contact with each other due to the air pressure to open the first and second discharge holes. Therefore, the additive may enter the inlet channel 700 or outlet pipe 800 through the opened first and second discharge holes. This is because the first and second check valves 420 and 470 are formed of an elastic material, the shape and position of the protrusion portion 423 and 473 and the hemisphere portion 424 and 474 may be changed by negative pressure or positive pressure.

According to an implementation of the present disclosure, the first and second check valves 420 and 470 may be formed of rubber. Since the first and second check valves 420 and 470 formed of an elastic material can be manufactured in a compact size in comparison with a check valve using a conventional spring, a structure such as a spring length and a shaft supporting the spring is not required so that the check valve can be miniaturized, and the size of the second space S2 formed through the check valve can be reduced.

However, the first and second check valves 420 and 470 are not limited to the above-described structure, and may be the above-described conventional check valves having an elastic plug, a spring, and a spring shaft.

In some cases, when the piston 580 of the pump 500 described later reciprocates within a cylinder, a space S2 of the first check valve housing should be formed with a volume equal to or greater than the reciprocating volume formed inside the cylinder. This is because when the piston reciprocating volume inside the cylinder exceeds the volume of the first check valve housing space S2, the additive may overflow into the inlet channel 700 or outlet pipe 800 described later.

In addition, the outlet connection pipe 480 connected to the outlet pipe 800 is formed in a lower position than the first discharge hole 421 which connects the space S1 of the docking pipe and the space S2 of the first check valve assembly to discharge the additive in the space S1 of the docking pipe into the space S2 of the first check valve assembly, and the second discharge hole 471 that connects the space S2 of the first check valve assembly and the space S3 of the second check valve assembly to discharge the additive in the second space S2 into the third space S3. Therefore, the additive that passed through the first and second discharge holes 421 and 471 can be more properly flowed into the outlet pipe 800 due to the potential energy.

Figure 17:
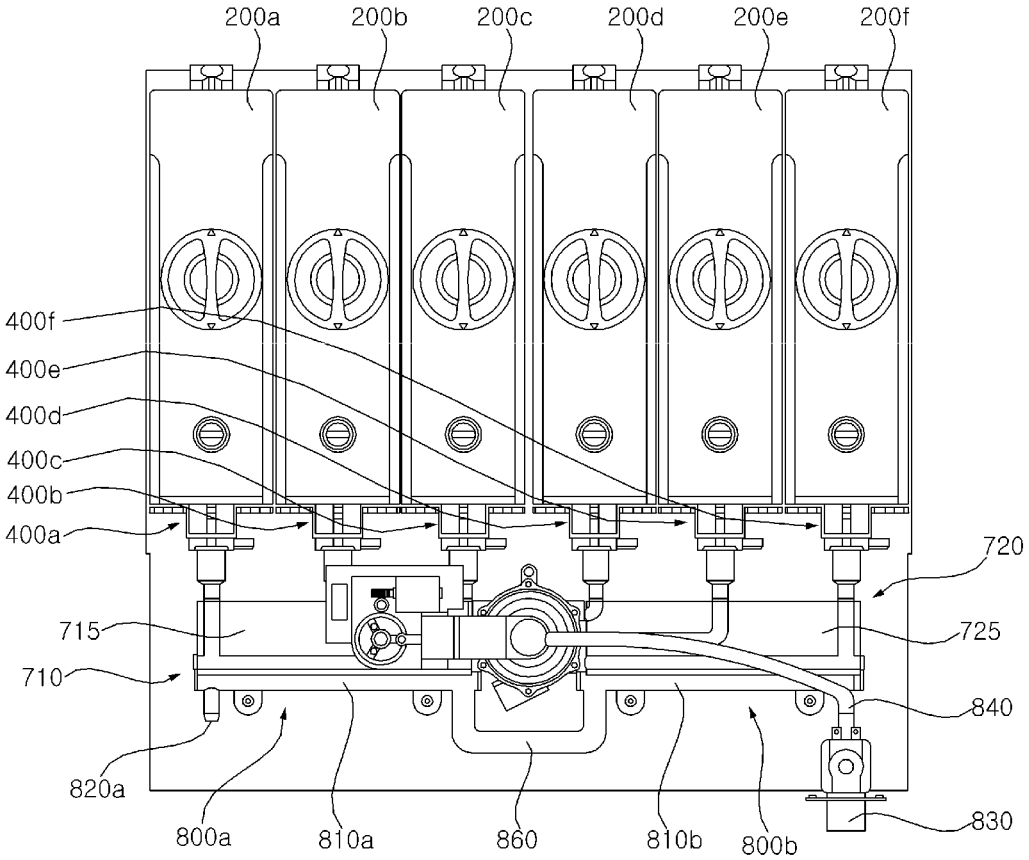
FIG. 17 is a plan view of an example washing machine according to one implementation of the present disclosure.

Hereinafter, the operation of the check valve assembly 400 will be described with reference to FIGS. 11 and 17.

Figure 16A:
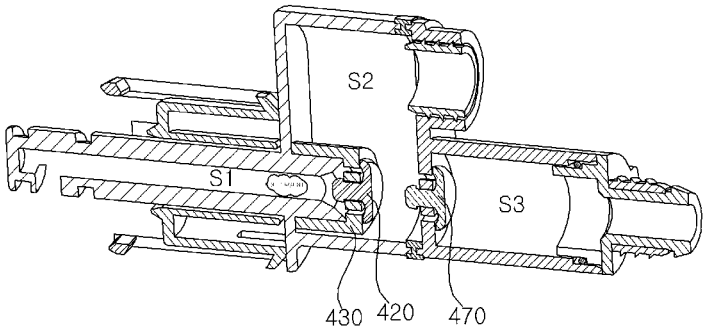
FIGS. 16A to 16C illustrate an example additive extraction process through a check valve.

FIG. 16A shows the state in which a cartridge 200 is inserted into the cartridge accommodating space and is coupled to the check valve assembly 400, and the additive (or detergent) is accommodated in the cartridge 200 and the inner space S1 of the docking pipe before the pump 500 is operated.

Figure 16B:
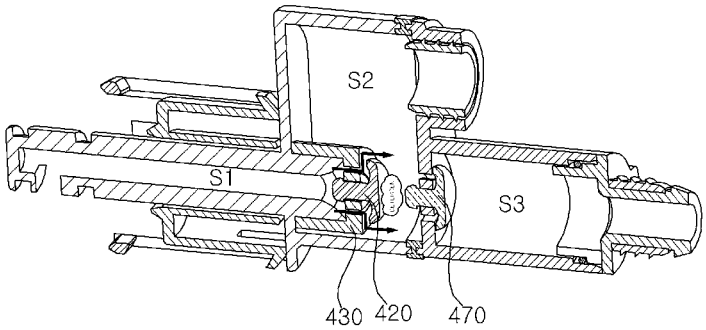

FIG. 16B shows a state in which the pressure in the space S2 of the first check valve housing 410 is decreased due to the retraction of the piston 580. The pressure is decreased in the space S2 of the first check valve housing 410, so that the first check valve 420 is opened and detergent is extracted into the space S2 of the first check valve housing 410, and the second check valve 470 is closed so that detergent is temporarily stored in the space S2 of the first check valve housing 410.

Figure 16C:
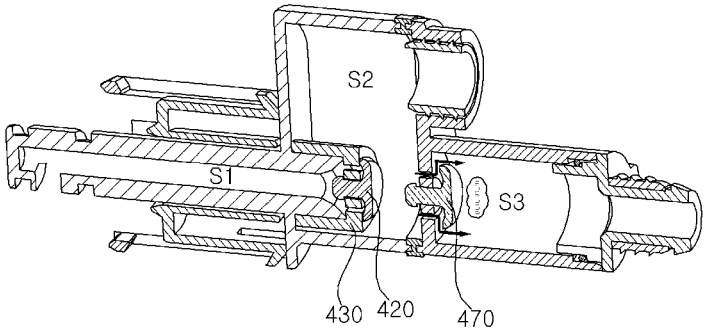

FIG. 16C shows a state in which the pressure in the space S2 of the first check valve housing 410 is increased as the piston 580 moves forward. The pressure is increased in the space S2 of the first check valve housing 410, so that the first check valve 420 is opened, and the second check valve 470 is closed. Accordingly, the additive temporarily stored in the first check valve housing 410 is discharged to the space S3 of the second check valve housing 460.

The negative pressure or positive pressure generated by the forward/rearward movement of the piston 580 provided in the pump 500 is transmitted to the space S2 (hereinafter, also referred to as a second space) of the first check valve housing 410 through the inlet channel 700.

When the piston 580 moves forward toward the inlet channel 700 in the cylinder, the first check valve 420 closes the first discharge hole, and the second check valve 470 opens the second discharge hole 471. When the piston 580 moves rearward to the opposite side of the inlet channel 700 in the cylinder, the first check valve 420 opens the first discharge hole 421, and the second check valve 470 closes the second discharge hole 471.

According to an implementation of the present disclosure, the piston 580 moves rearward, and thus, the generated negative pressure is transmitted to the second space S2 through the inlet channel 700. Therefore, the first check valve 420 is opened by the negative pressure applied to the second space S2. In addition, the additive inside the cartridge 200 enters the second space S2 via the first check valve 420 through the space S1 (hereinafter, also referred to as a first space) of the docking pipe 440 due to the negative pressure applied to the second space S2.

When the additive enters the second space S2, the piston 580 moves forward, and thus, the generated positive pressure is transmitted to the second space S2 through the inlet channel 700 again. Therefore, the second check valve 470 is opened by the positive pressure applied to the second space, and the first check valve 420 is positioned while being blocked. Therefore, the additive in the second space S2 is supplied to the space S3 (hereinafter, also referred to as a third space) of the second check valve housing 460, due to positive pressure applied to the second space S2. The additive supplied to the third space S3 may be discharged to the outlet pipe 800 by positive pressure applied to the second space S2 and the third space S3, and may be supplied to the tub 31 or a drawer 39 together with supplied water.

As described above, the check valve according to the implementation of the present disclosure is designed to effectively transmit the pressure change due to the piston reciprocating motion when discharging the additive in a container by applying the pressure change due to the piston motion, two first and second check valves 420 and 470 are used to discharge additive during reciprocating motion of the piston, in order to move the liquid according to the pressure change.

Hereinafter, the structure and operation of the pump 500 will be described with reference to FIGS. 5 to 8 and 13.

The detergent supply device 100 may include one or more pumps 500. The pump 500 may be provided in a number less than the number of cartridges 200.

The detergent supply device 100 includes a single pump 500 and a single flow path switching valve 600 to selectively extract the additive contained in the plurality of cartridges 200.

Alternatively, the detergent supply device 100 may include two or more pumps 500 and the flow path switching valve 600 having the same number as the pump 500.

For example, the detergent supply device 100 may include two first and second pumps 500 and two first and second flow path switching valves 600. The first pump may be connected to some cartridges (e.g., 200*a*, 200*b*, 200*c*) which are one or more of the plurality of cartridges 200*a*, 200*b*, 200*c*, 200*d*, 200*e*, 200*f* through the first flow path switching valve, can selectively extract the additive contained therein, and the second pump may be connected to the remaining part of the cartridges (e.g., 200*d*, 200*e*, 200*f*) through the second flow path switching valve, so that the additive contained therein can be selectively extracted.

Alternatively, the detergent supply device 100 may include two or more pumps 500 and fewer flow path switching valves 600 than the pumps 500.

For example, the detergent supply device 100 may include two first and second pumps 500 and a single flow path switching valve 600. The first pump is not connected to a flow path switching valve, but connected to any one cartridge (e.g., 200*a*) of the plurality of cartridges 200*a*, 200*b*, 200*c*, 200*d*, 200*e*, 200*f* so that the additive contained therein can be extracted. The second pump is connected to the remaining cartridges (e.g. 200*b*, 200*c*, 200*d*, 200*e*, 200*f*) through a flow path switching valve, so that the additive contained therein can be selectively extracted.

In some cases, a plurality of inlet channels 700 may also be provided. At least one inlet channel 700 may include two or more flow paths respectively communicating with two or more check valve assemblies of the plurality of check valve assemblies 400.

The pump 500 may change the pressure of the space S2 formed in the check valve assembly 400 communicating with two or more flow paths of the inlet channel 700 to extract additive, and the flow path switching valve 600 may selectively communicate the pump 500 with any one of two or more flow paths of the inlet channel 700. The flow path switching valve 600 may communicate the cylinder 590 of the pump 500 with any one of two or more flow paths of the inlet channel 700. When the pump is operated, the additive may be extracted to the space S2 formed in the check valve assembly in communication with the cylinder 590 and any one flow path.

In some cases, when the detergent supply device 100 includes a plurality of pumps 500, cartridges connected to different pumps may be classified and may guide a user to contain additive.

For example, it is known that general detergents and fabric softeners are easily hardened when mixing. Therefore, each cartridge can be marked so that the general detergent can be contained in any one of the cartridges connected to the first pump, and the fabric softener can be contained in any one of the cartridges connected to the second pump. In addition, since babies have weak skin, it is undesirable to mix bleach when washing baby clothes. Accordingly, each cartridge can be marked so that the baby clothes detergent can be contained in another of the cartridges connected to the first pump, and the bleach can be contained in the other of the cartridges connected to the second pump.

Hereinafter, the case where the detergent supply device 100 is provided with one pump 500 will be described as an example, but the number of the pumps 500 is not limited to one, and it is sufficient if at least one pump 500 is connected to two or more cartridges 200 through the flow path switching valve 600, the inlet channel 700, and the check valve assembly 400.

The pump 500 may include a pump housing 510 for accommodating pump parts, a piston 580 for changing the pressure in the space S2 of the first check valve housing through the forward/rearward movement, a cylinder 590 forming a space for the piston to move forward and rearward, a motor 520 for generating power, a first gear 530 rotated by the motor 520, a second gear 540 rotating in engagement with the first gear, a third gear 550 rotates with the second gear 540, a crank gear 560 rotates in engagement with the third gear, and a connecting rod 570 connecting the crank gear and the piston.

The piston 580 may perform reciprocating motion in a direction parallel to the direction in which the plurality of cartridges 200 are arranged, and the motor 520 may have a drive shaft disposed parallel to the direction in which the piston 580 performs reciprocating motion.

For example, the cartridge 200 is formed long in the front-rear direction of the washing machine, a plurality of cartridges may be installed in a line in the left-right direction of the washing machine, and the piston 580 can perform reciprocating motion in the left-right direction of the washing machine. In addition, the motor 520 may be arranged such that the drive shaft is aligned in the left-right direction.

The first gear 530 may be coupled to the drive shaft of the motor 520 and may rotate integrally with the drive shaft. The first gear 530 may be formed of a helical gear. Through the helical gear, noise from the motor 520 can be reduced, and power transmission can be easily performed. The second gear 540 may be formed of a worm gear. Since the pump 500 is located between configurations such as the inlet channel 700 and outlet pipe 800, and the flow path switching valve 600, it is necessary to dispose the assembly accommodation space as densely as possible for efficient use of space. Therefore, according to the implementation of the present disclosure, the motor 520 is laid down and the second gear 540 is formed of a worm gear so that the rotational power direction can be switched and transmitted.

The second gear 540 and the third gear 550 rotate together. The crank gear 560 rotates in engagement with the third gear 550. The number of gear teeth of the crank gear is formed much more than the number of gear teeth of the third gear 550, so that a stronger force can be transmitted due to the gear ratio during the reciprocating motion of the piston 580.

The crank gear 560 includes a crank shaft 561 forming a rotation axis of the crank gear, a crank arm 562 extended from the crank shaft, and a crank pin 563 connected to a connecting rod 570. The crank pin 563 and the connecting rod 570 are rotatably coupled, and when the crank gear 560 rotates, as the crank pin 563 rotates, the connecting rod 570 may move linearly in the direction that the cylinder 590 forms.

The connecting rod 570 is coupled to the piston 580, and the piston 580 is inserted into the cylinder 590 and can reciprocate in the longitudinal direction of the cylinder 590. Through the linear motion of the piston 580, positive or negative pressure may be transmitted to the flow path switching valve 600 connected to the cylinder 590. When the piston moves in the direction of the flow path switching valve 600, positive pressure is transmitted to the flow path switching valve 600, and when the piston moves in the opposite direction of the flow path switching valve 600, negative pressure is transmitted to the flow path switching valve 600.

Hereinafter, the flow path switching valve 600 will be described with reference to FIGS. 5 to 8, 12, 14 and 15.

The flow path switching valve 600 is connected to the pump 500 and the inlet channel 700. The flow path switching valve 600 selectively communicates the cylinder 590 of the pump 500 with any one flow path 700 (e.g. 700*a*) of the plurality of flow paths of the inlet channel 700.

As described later, a first outlet pipe 800*a* and a second outlet pipe 800*b* may be disposed to be spaced apart from each other in a direction in which the plurality of cartridges 200 are arranged. The flow path switching valve 600 may be disposed between a gap where the first and second outlet pipes 800*a* and 800*b* are spaced apart.

The flow path switching valve 600 includes a first housing 610 connected to the cylinder 590 of the pump 500, a second housing 650 coupled with the first housing, a disk 620 rotatably disposed in a space formed by the first housing 610 and the second housing, a spring valve 630 installed in the disk 620, a flow path switching motor 670 for rotating the disk, a shaft 640 for transmitting the rotational force of the flow path switching motor 670 to the disk 620, a micro switch 660 for inputting the rotational position of the disk 620 to the controller 3, and a plane cam 645 that rotates with the shaft 640 and opens and closes the current flowing through the micro switch 660.

The first housing 610 may form an upper outer shape of the flow path switching valve 600, and the second housing 650 may form a lower outer shape of the flow path switching valve 600. Accordingly, the first housing 610 may be referred to as an upper housing 610, and the second housing 650 may be referred to as a lower housing 650.

The spring valve 630 includes a spring 631 that provides elastic force, a spring shaft 632 that helps prevent the spring 631 from being separated, and a plug part 633 that can block a flow path connection hole 651*a* by the elastic force of the spring.

The disk 620 is provided with an insertion hole 621 into which the spring shaft 632 is inserted so as to fix the position of the spring valve, and a disk hole 622 through which the fluid passes. The fluid introduced into the flow path switching valve 600 may pass through the disk 620 through the disk hole 622, and may partially pass through the insertion hole 621.

In another implementation of the present disclosure, a water supply port 615 (see FIGS. 17 to 19B) is formed in the first housing 610 to be connected to the water supply valve 830.

The second housing 650 is provided with a plurality of inlet connection ports 653*a*, 653*b*, 653*c*, 653*d*, 653*e*, 653*f* (hereinafter, 653) coupled to a plurality of flow paths of the inlet channel 700, and a plurality of flow path connection holes 651*a*, 651*b*, 651*c*, 651*d*, 651*e*, 651*f* (hereinafter, 651) communicating with a plurality of inlet connection port 653 respectively. The fluid that passed through the disk hole 622 and the insertion hole 621 of the disk 620 may pass through each inlet connection port 653 through the flow path connection hole 651 and then may be supplied to each inlet channel 700 connected to the inlet connection port 653.

The spring valve 630 may selectively open and close some of the plurality of flow path connection holes 651. When the disk 620 rotates and the spring valve 630 closes some of the plurality of flow path connection holes 651, the other may be opened.

In order to supply a plurality of additive, a plurality of flow path connection holes 651*a* may be opened, and a plurality of spring valves 630 may also be formed to block a plurality of flow path connection holes.

The spring valve 630 may be provided in a smaller number than the plurality of flow path connection holes 651, and preferably, may be provided in one less number than the number of the plurality of flow path connection holes 651. That is, the spring valve 630 may be provided in one less number than the number of the plurality of cartridges. In this case, one flow path connection hole 651 (e.g. 651*a*) may be opened, and the other flow path connection holes 651 (e.g. 651*b* to 651*f*) may be closed. Accordingly, the additive may be extracted from the cartridge 200*a* and discharged into the outlet pipe 800 by changing the pressure of the space S2 formed in the check valve assembly 400*a* connected to one cartridge (e.g. 200*a*) of the plurality of cartridges 200.

When the additive to be supplied is selected, power is supplied to the flow path switching motor 670 to be driven.

The driven flow path switching motor 670 rotates the shaft 640 connected thereto and the disk 620 connected to the shaft 640.

At this time, the spring valve 630 installed in the disk 620 can also rotate together according to the rotation of the disk. When the flow path connection hole 651 of the lower housing 650 is located in the rotational position of the spring valve 630, the flow path connection hole 651 may be blocked by the plug part 633 due to the elastic force of the spring 631.

In order to connect the pump 500 and the check valve assembly 400*a* connected to the cartridge 200*a* containing the additive to be supplied, the controller 3 may control the rotation angle of the disk 620 so that the spring valve 630 is not located in the flow path connection hole 651*a* connected to the check valve assembly 400*a*.

If the spring valve 630 is not located in the flow path connection hole 651*a*, the pump 500 and the flow path connection hole 651*a* are opened, and positive or negative pressure generated in the pump 500 is sequentially transmitted to the flow path 700*a* of the inlet channel and the check valve assembly 400*a* through the flow path connection hole 651*a*, so that the additive of the cartridge 200 can be supplied to the outlet pipe 800.

In addition, in order to block the pump 500 and the check valve assembly 400*a* connected to the cartridge containing the additive that do not need to be supplied, the spring valve 630 may be located in the flow path connection hole 651*a* connected to the check valve assembly 400*a*, and the rotation angle of the disk can be controlled so that the plug part 633 blocks the flow path connection hole 651*a* due to the elastic force of the spring 631.

When the spring valve 630 is located in the flow path connection hole 651*a*, the pump 500 and the flow path connection hole 651*a* are blocked, and positive or negative pressure generated in the pump 500 is not transmitted to the check valve assembly 400*a*, so that the additive of the cartridge 200 does not flow.

When the spring valve 630 of the disk 620 is not in the position of the flow path connection hole 651*a*, the spring valve 630 is located while being compressed in a lower housing upper surface 652, and then, when the spring valve 630 moves to the position of the flow path connection hole 651*a* through the rotation of the disk 620, the spring valve 630 is tensioned to block the flow path connection hole 651*a*.

In order to accurately control the rotation angle of the disk 620, the flow path switching valve 600 includes a micro switch 660 and a plane cam 645. The plane cam 645 may be integrally formed with the shaft 640 or coupled to the shaft 640 to rotate integrally with the shaft 640 and the disk 620.

The micro switch 660 may include an actuator, and an electric circuit can be changed by the movement of the actuator. In some cases, other types of mechanical or electronic switches and/or sensors may be used.

A cam is generally a device having a specific contour (or groove) that performs a rotation movement (or reciprocating motion), and the plane cam 645 is a type of cam and refers to a contour indicating a plane curve.

Figure 8:
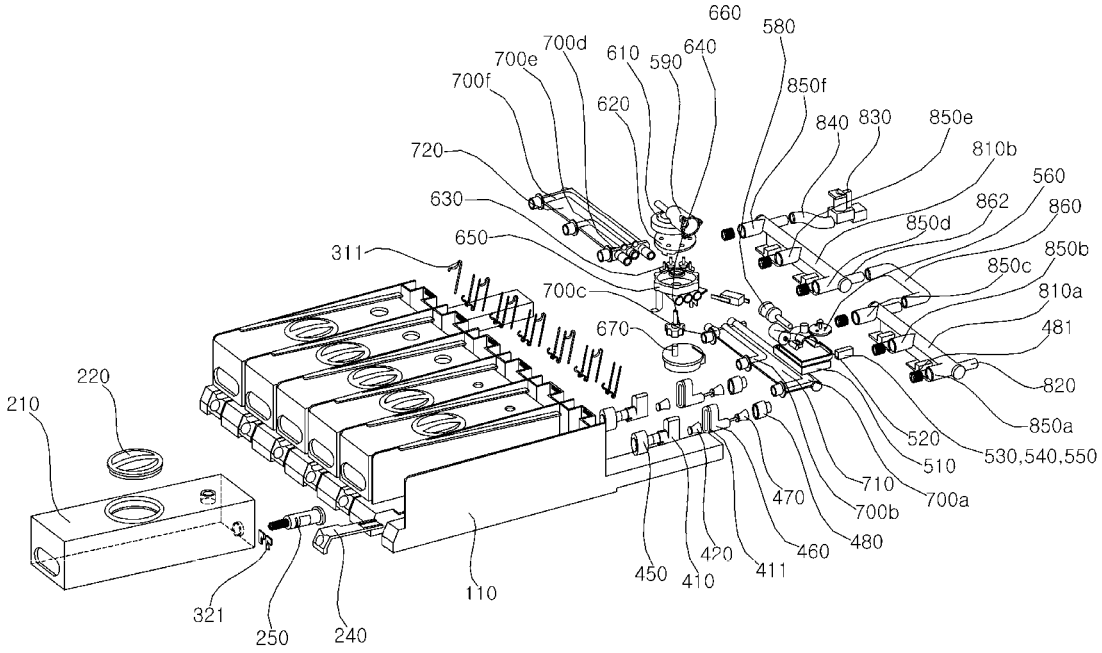
FIG. 8 is an exploded perspective view of the detergent supply device shown in FIG. 5.
Figure 9:
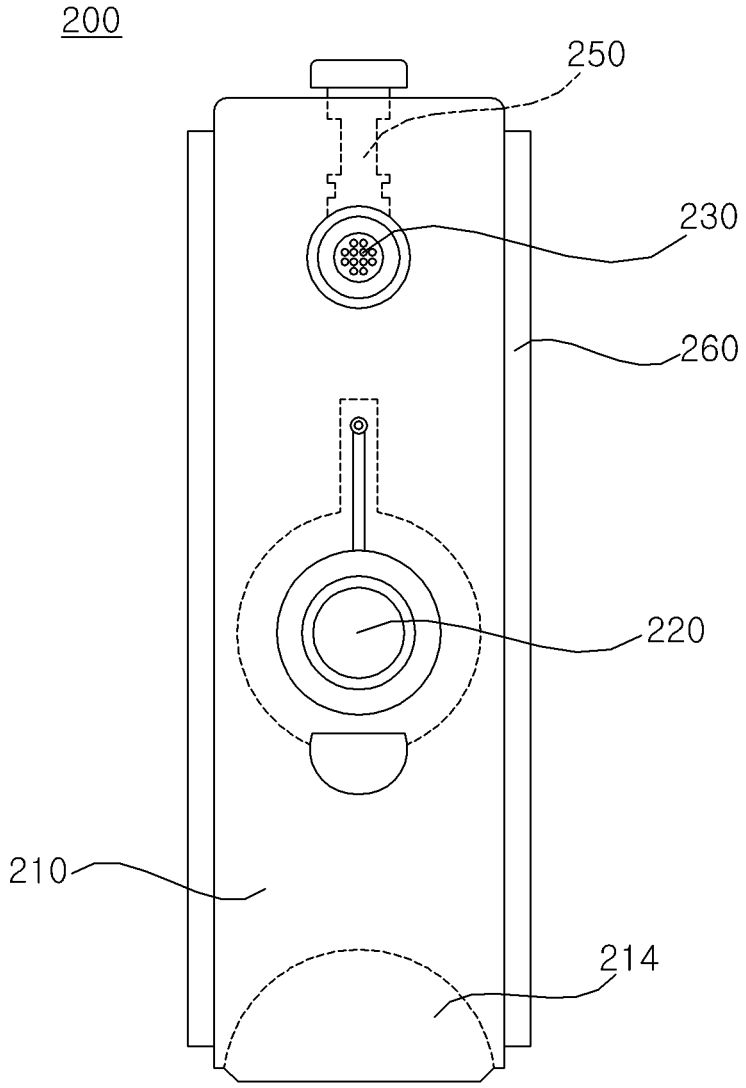
FIG. 9 is a plan view of an example cartridge shown in FIG. 7.
Figure 10:
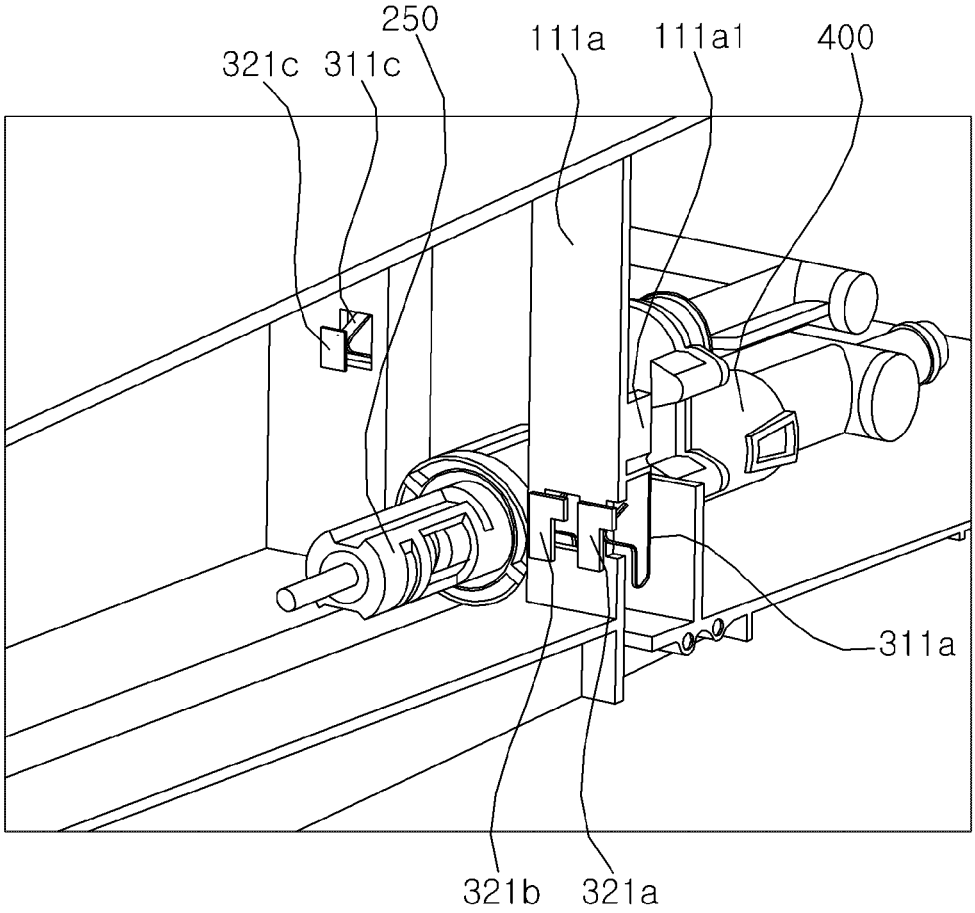
FIG. 10 is a perspective view showing exemplary implementations of a docking valve, a check valve assembly, and an electrode sensor shown in FIG. 8.
Figure 12:
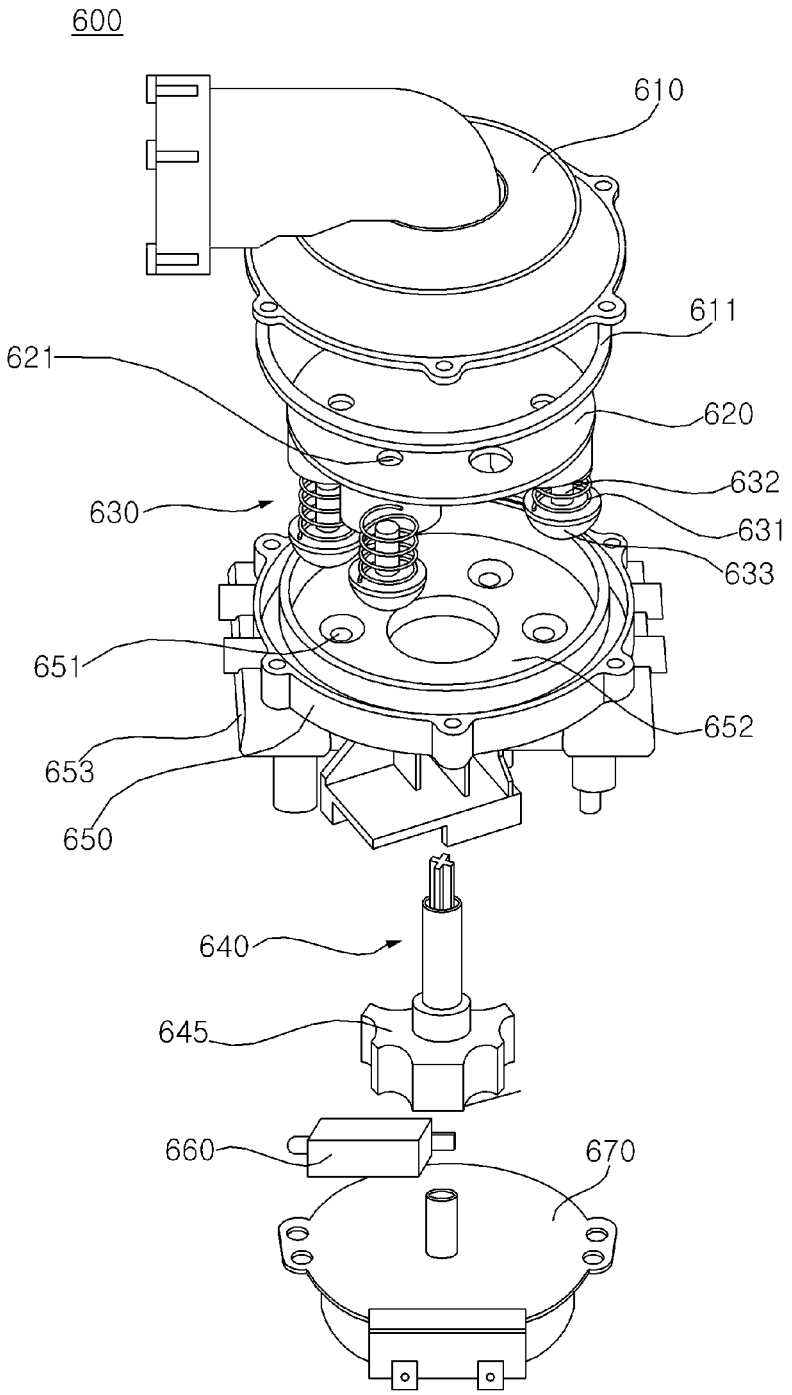
FIG. 12 is an exploded perspective view of an example flow path switching valve shown in FIG. 8.
Figure 13:
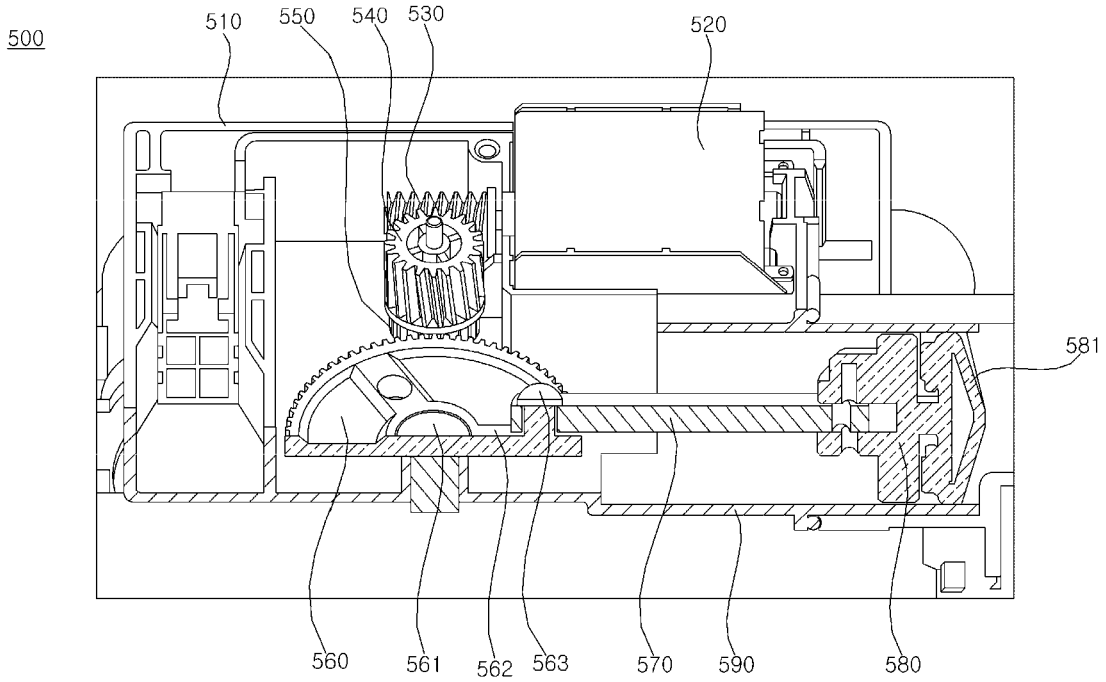
FIG. 13 is a cross-sectional view showing an example pump shown in FIG. 8.
Figure 14:
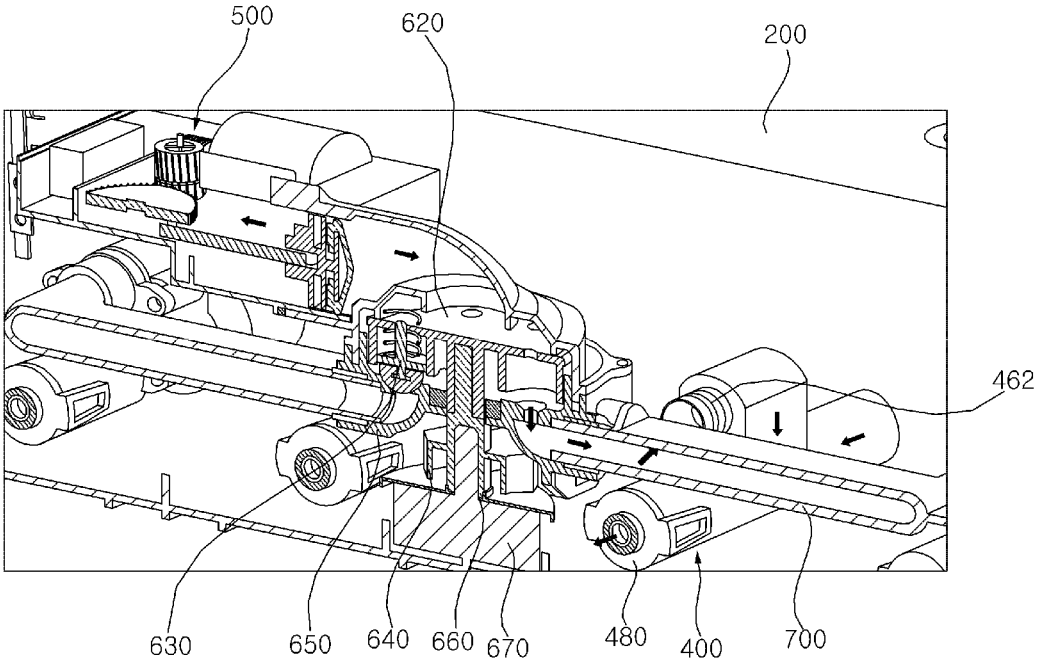
FIG. 14 is a cross-sectional view illustrating an example pressure change through a flow path switching valve.
Figure 15:
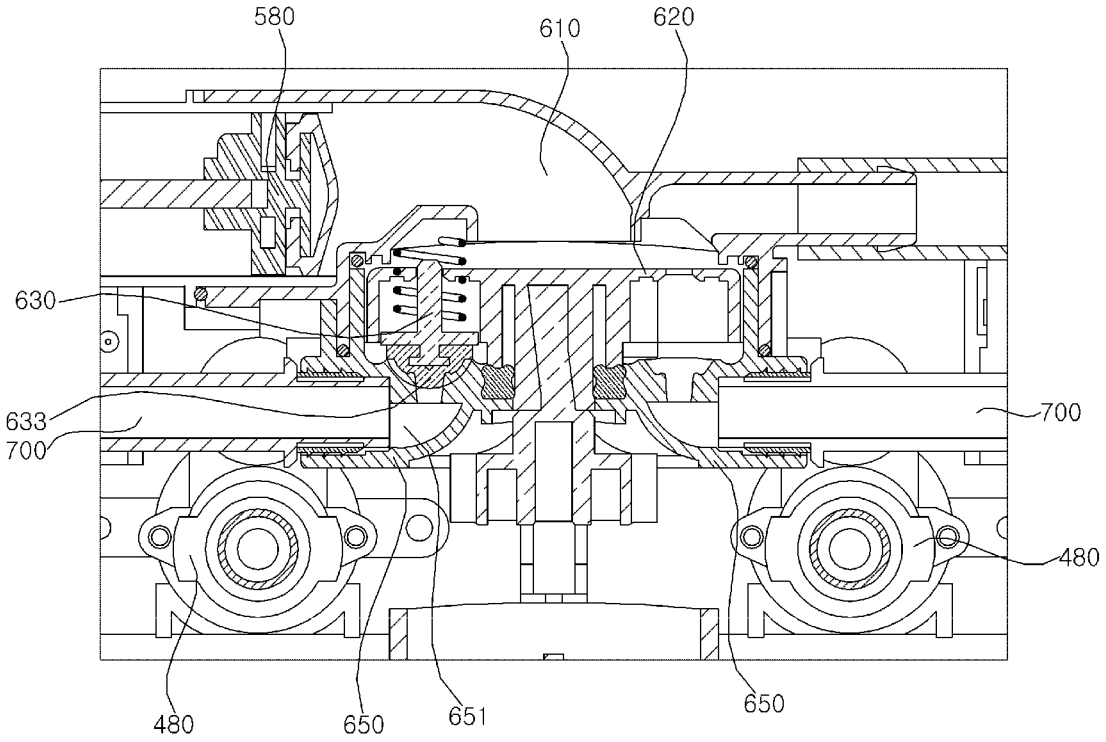
FIG. 15 is a cross-sectional view of an example flow path switching valve.

Referring to FIGS. 8 and 12, the plane cam 645 forms a specific contour having a plurality of protrusion portions with different shapes and a separation distance, and as the plane cam 645 rotates, the protrusion portion can open and close the current by pressing the actuator provided in the micro switch 660. The controller 3 may determine and control the rotational position of the disk 620 due to a pattern in which the current is opened and closed.

The plane cam 645 and the shaft 640 rotate in combination with the drive shaft of the flow path switching motor, and the micro switch 660 is disposed such that the actuator contacts the plane cam 645. In an implementation of the present disclosure, the flow path switching motor 670 is disposed below the lower housing 650, and the plane cam 645 and the micro switch 660 may be located between the flow path switching motor 670 and the lower housing 650.

Hereinafter, the inlet channel 700 and outlet pipe 800 will be described with reference to FIGS. 5 to 8.

The detergent supply device 100 includes an inlet channel 700 that transmits the pressure change generated by the reciprocating motion of the piston 580 to the space S2 formed in the plurality of check valve assemblies 400. The inlet channel 700 includes a plurality of flow paths 700*a*, 700*b*, 700*c*, 700*d*, 700*e*, 700*f* (hereinafter, 700*a*) communicating with the space S2 formed in the plurality of check valve assemblies 400 respectively.

The inlet channel 700 is connected to the flow path connection portion 461 of the check valve assembly 400, and is connected to the inlet connection port 653 of the flow path switching valve 600 to transmit the flow of the fluid transmitted through the pump 500 to the check valve assembly 400.

The plurality of flow paths 700*a* are connected to a plurality of inlet connection portions 461*a*, 461*b*, 461*c*, 461*d*, 461*e*, 461*f*, and inlet connection ports 653*a*, 653*b*, 653*c*, 653*d*, 653*e*, 653*f* respectively.

The inlet channel 700 may include a first inlet channel having a portion 700*a*, 700*b*, 700*c* of the plurality of flow paths 700*a*, 700*b*, 700*c*, 700*d*, 700*e*, 700*f*, and a second inlet channel having a remaining portion 700*d*, 700*e*, 700*f* of the plurality of flow paths 700*a*, 700*b*, 700*c*, 700*d*, 700*e*, 700*f*.

In some cases, three cartridges 200 and a check valve assembly 400 connected thereto may be disposed respectively in the left and right sides, and the flow path switching valve 600 may be located in the center of the rear side of the cartridge.

The first inlet channel 710 and the second inlet channel 720 may be coupled with the flow path switching valve 600, and may be symmetrically coupled with respect to a straight line passing through the center of the flow path switching valve 600.

The flow path 700*a*, 700*b*, 700*c* provided in the first inlet channel 710 may be respectively connected to the inlet connection portion 461*a*, 461*b*, 461*c* of the left check valve assembly 400*a*, 400*b*, 400*c* and the flow path discharge holes 653*a*, 653*b*, 653*c* formed side by side in the left side of the flow path switching valve 600.

The flow path 700*d*, 700*e*, 700*f* provided in the second inlet channel 720 may be respectively connected to the inlet connection portion 461*d*, 461*e*, 461*f* of the right check valve assembly 400*d*, 400*e*, 400*f*, and the flow path discharge hole 653*d*, 653*e*, 653*f* formed side by side in the right side of the flow path switching valve 600.

The first inlet channel 710 is integrally formed through a first flow path plate 715 to fix a plurality of flow paths 700*a*, 700*b*, 700*c*, and the second inlet channel 720 is integrally formed through a second flow path plate 725 to fix a plurality of flow paths 700*d*, 700*e*, 700*f*, thereby stably supplying the fluid.

In some cases, the water supplied from the water supply valve 830 and the additive extracted from the cartridge 200 flow through the outlet pipe 800. The outlet pipe 800 may include a plurality of check valve connection pipes 850*a*,

850*b*, 850*c*, 850*d*, 850*e*, 850*f* (hereinafter, 850) which are respectively connected to a plurality of check valve assemblies 400.

The outlet pipe 800 may include a joint pipe 810*a*, 810*b* in which a flow path communicating with a plurality of check valve connecting pipes 850 is formed, and through which water supplied from the water supply valve 830 and additive extracted from the cartridge 200 flow, and a discharge port 820*a* which communicates with the flow path of the joint pipe 810*a*, 810*b* and is connected to the tub 31 to discharge the water and additive. In addition, the outlet pipe 800 may include a water supply port 820*b* which is connected to the water supply valve 830 to receive the water supplied from the water supply valve 830, and communicates with the flow path of the joint pipe 810*a*, 810*b*.

The outlet pipe 800 is connected to the outlet connection pipe 481 of the check valve assembly 400, so that the additive discharged through the outlet connection pipe 481 is supplied to the tub 31 or drawer 39 through the discharge hole 820.

The detergent supply device 100 includes a water supply valve 830 receiving water from an external water source, and the water supply valve 830 may be connected to a water supply port 820*b* through a water supply hose 840. The water supplied through the water supply valve 830 passes through the water supply hose 840 and is guided to the outlet pipe 800.

The water thus guided flows along the joint pipe 810*a*, 810*b* toward the discharge port 820*a* located in the opposite side of the water supply port 820*b*, and is supplied through the check valve connection pipe 850 to dilute the additive introduced into the outlet pipe 800 and be discharged together with the additive to the discharge port 820*b*.

The check valve connection pipe 850 protrudes from the joint pipe 810*a*, 810*b* toward the cartridge (e.g. toward the front), and the discharge port 820*a* and the water supply port 820*b* may protrude toward the rear from the joint pipe 810*a*, 810*b*.

The check valve connection pipe 850 is connected to each outlet connection pipe 480, and the additive discharged from the outlet connection pipe 480 may be introduced into the outlet pipe 800 through the check valve connection pipe 850.

The outlet pipe 800 may include the first outlet pipe 800*a*, the second outlet pipe 800*b*, and a connection hose 860 which connects the first outlet pipe 800*a* and the second outlet pipe 800*b*.

The first outlet pipe 800*a* may include a portion 850*a*, 850*b*, 850*c* of the plurality of check valve connection pipes, the discharge port 820*a*, and the first joint pipe 810*a* having a flow path communicating therewith. The second outlet pipe 800*b* may include a remaining portion 850*d*, 850*e*, 850*f* of the plurality of check valve connection pipes, the water supply port 820*b*, and the second joint pipe 810*b* having a flow path communicating therewith.

The first outlet pipe 800*a* may include a first connection port 861 in communication with the first joint pipe 810*a*, and the second outlet pipe 800*b* may include a second connection port 862 in communication with the second joint pipe 810*b*. The connection hose 860 may be connected to the first connection port 861 and the second connection port 862.

The first outlet pipe 800*a* and the second outlet pipe 800*b* are disposed to be spaced apart from each other in a direction in which a plurality of cartridges 200 are arranged (e.g. the left and right direction of washing machine), and thus the flow path switching valve 600 may be disposed in a spaced gap between the first and second outlet pipes 800*a*, 800*b*.

In order to reduce or prevent the interference between the outlet pipe 800 and the flow path switching valve 600 as much as possible, the connection hose 810 may be installed in a deflected shape such as u-shape to secure the installation space of the flow path switching valve 600.

Hereinafter, a water supply valve of a washing machine according to an implementation of the present disclosure will be described with reference to FIGS. 5 to 8 and 18.

The water supply valve 830 of the washing machine according to an implementation of the present disclosure is connected to the water supply port 820*b* provided in the outlet pipe 800 to supply water to the outlet pipe 800. The water supply valve 830 and the water supply port 820*b* are connected through the water supply hose 840. However, since the water supply valve 830 is not connected to the outlet pipe through the flow path switching valve 600, the inlet channel 700, the check valve assembly 400, etc. it can be said that the water supply valve and the outlet path are directly connected.

The washing machine according to an implementation of the present disclosure uses air as a fluid for driving the first and second check valves 420 and 470. The cylinder 590, the inlet channel 700 are filled with air, and the air flows through the space S2 formed in the cylinder 590, the inlet channel 700, and the check valve assembly 400 due to the reciprocating motion of the piston 580. Accordingly, the changed pressure is transmitted to the space S2 formed in the check valve assembly 400.

Figure 18A:
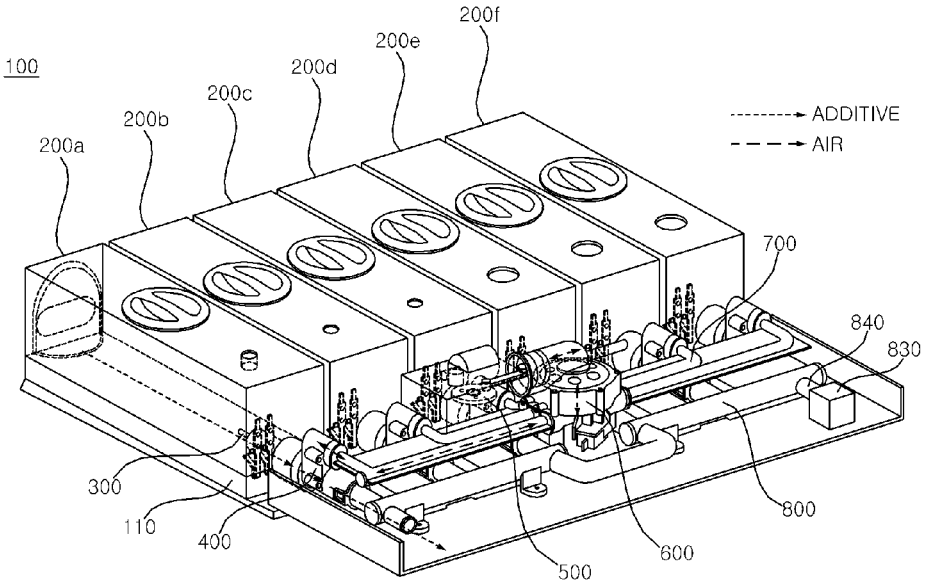
FIGS. 18A and 18B are perspective views illustrating an example flow of additive, air, and water according to one implementation.
Figure 18B:
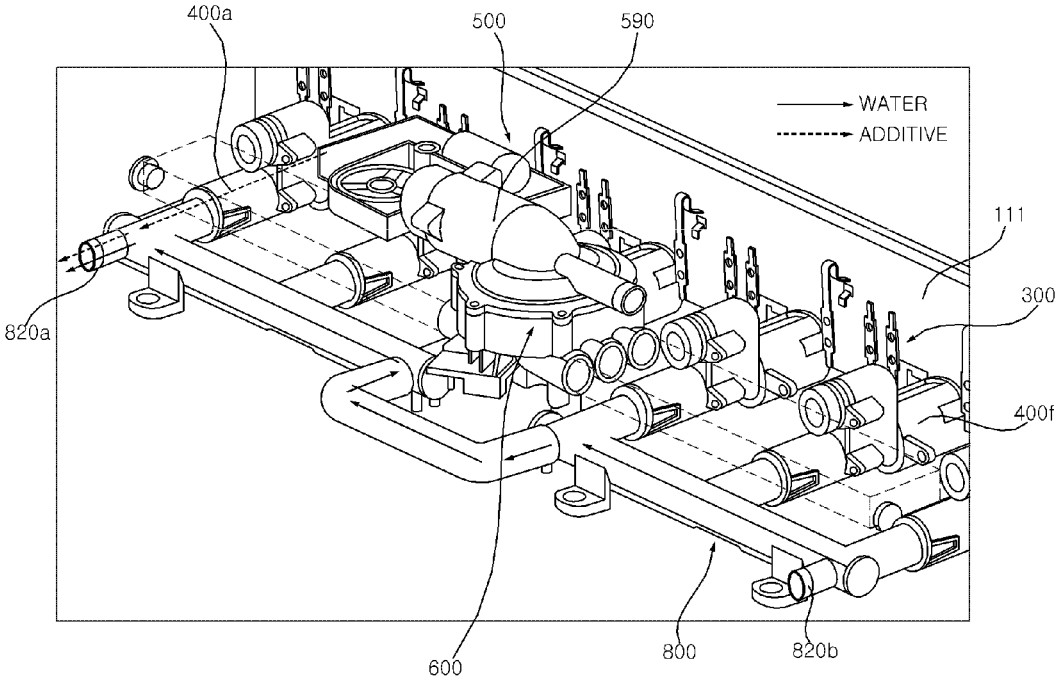

Referring to FIGS. 18A and 18B, a flow path 700*a* communicating with the cylinder, among the plurality of flow paths of the inlet channel 700 by the flow path switching valve 600. The space S2 formed in a check valve assembly 400*a* among the plurality of the check valve assemblies 400 is communicated with the flow path 700*a* of the inlet channel 700. The pressure change due to the reciprocating motion of the piston 580 is transmitted to the space S2 formed in the check valve assembly 400*a*. Therefore, the additive is extracted from the cartridge 200*a* and discharged to the outlet pipe 800.

When the additive is discharged to the outlet pipe 800, the controller 3 opens the water supply valve 830 to supply water to the outlet pipe 800. Accordingly, the additive is added to the tub 31 or drawer 38 together with water.

Figure 19A:
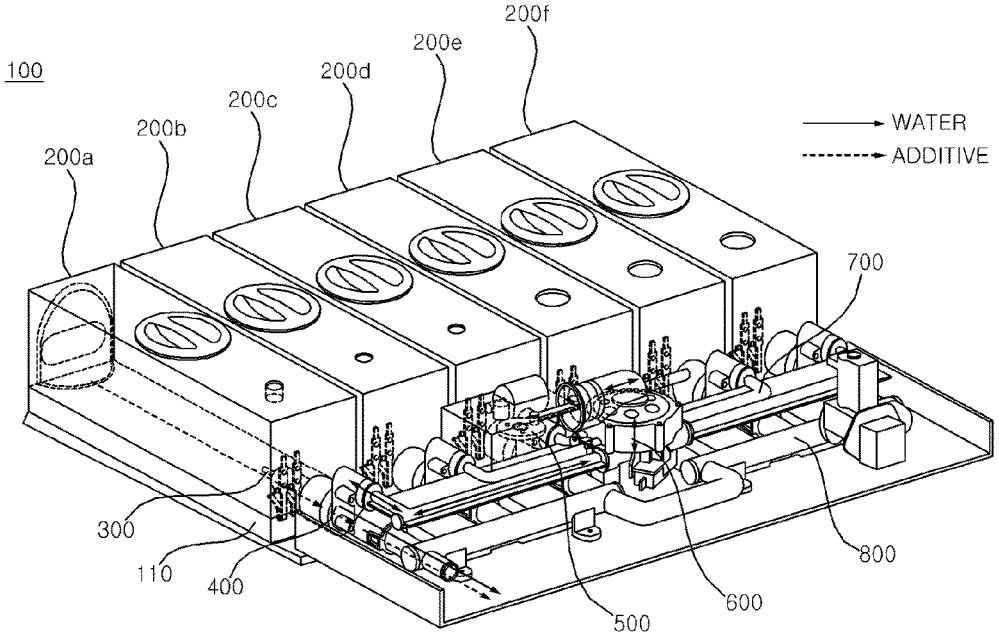
FIGS. 19A and 19B are perspective views illustrating an example flow of water and additives according to one implementation.
Figure 19B:
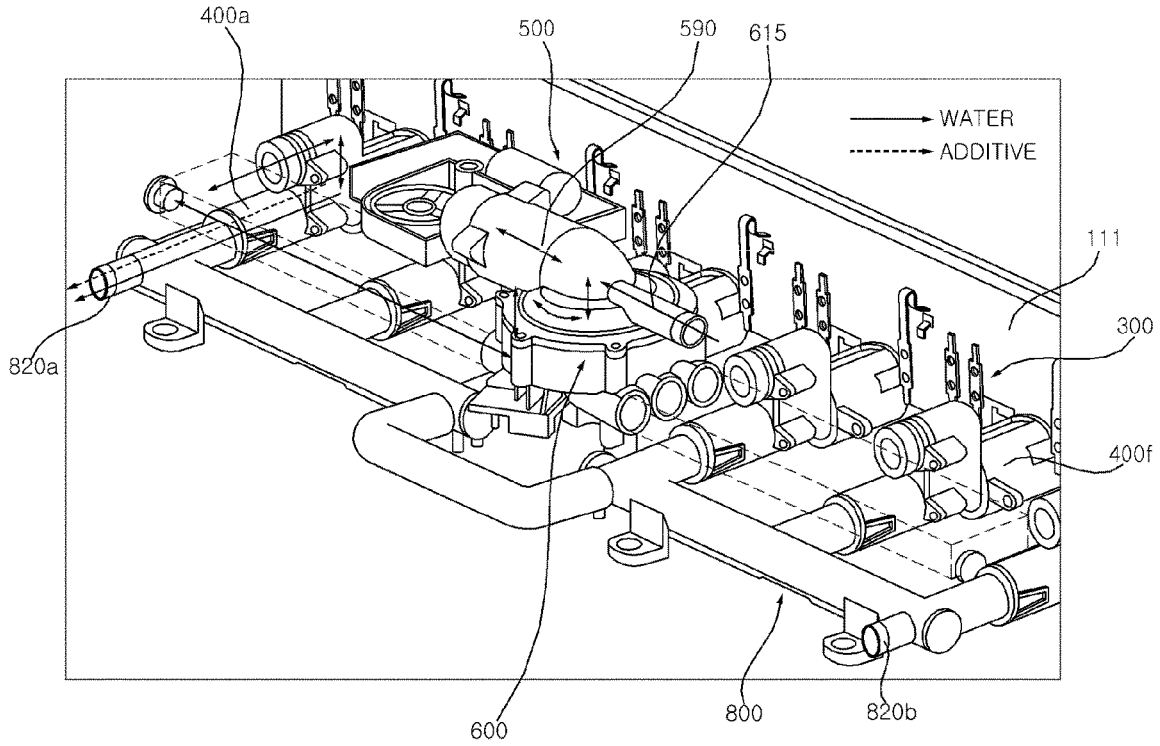

Hereinafter, a water supply valve of a washing machine according to another implementation of the present disclosure will be described with reference to FIGS. 17, 19A, and 19B.

Unlike the above, the water supply valve 830 of the washing machine according to another implementation of the present disclosure may be connected to the flow path switching valve 600 or the pump 500, so that water can be supplied to the flow path switching valve 600 or the pump 500. The water supply valve 830 may not supply water directly to the outlet pipe 800, but may supply water to the outlet pipe through the flow path switching valve 600, the inlet channel 700, and the check valve assembly 400.

A water supply port 615 communicating with the cylinder 590 may be formed in the upper housing 610 of the flow path switching valve 600. The water supply valve 830 is connected to the water supply port 615 formed in the upper housing 610. The water supply valve 830 and the water supply port 615 may be connected by the water supply hose 840.

In this case, the above-described water supply valve 830 is not formed in the outlet pipe 800, or the water supply valve 830 is sealed by a separate plug or the like.

The washing machine according to another implementation of the present disclosure uses water as a fluid for driving the first and second check valves 420 and 470. The cylinder 590 and the inlet channel 700 are filled with water, and water flows through the space S2 formed in the cylinder 590, the inlet channel 700, and the check valve assembly 400 due to the reciprocating motion of the piston 580. Accordingly, the changed pressure is transmitted to the space S2 formed in the check valve assembly 400.

When the additive to be input is selected, the controller 3 controls the flow path switching valve 600 to communicate the cylinder 590 with the inlet channel 700 and the check valve assembly 400*a* connected to the cartridge 200*a* containing the selected additive, opens the water supply valve 830 to supply water to the cylinder 590, the flow path switching valve 600, the flow path 700*a*, among the plurality of flow paths of the inlet channel 700, communicating with the cylinder, and the space S2 of the check valve assembly 400*a*.

After water is supplied, the pump is driven to extract additive from the cartridge 200*a* and discharge the water together with additive to the outlet pipe 800.

In some cases, when the water supply valve 830 is opened while the operation of the pump 500 is stopped, water is introduced so that the pressure in the space S2 of the check valve assembly 400*a* communicating with the cylinder 590 increases, and the second check valve 470 is opened, so that water may be discharged to the outlet pipe 800.

Figure 20:
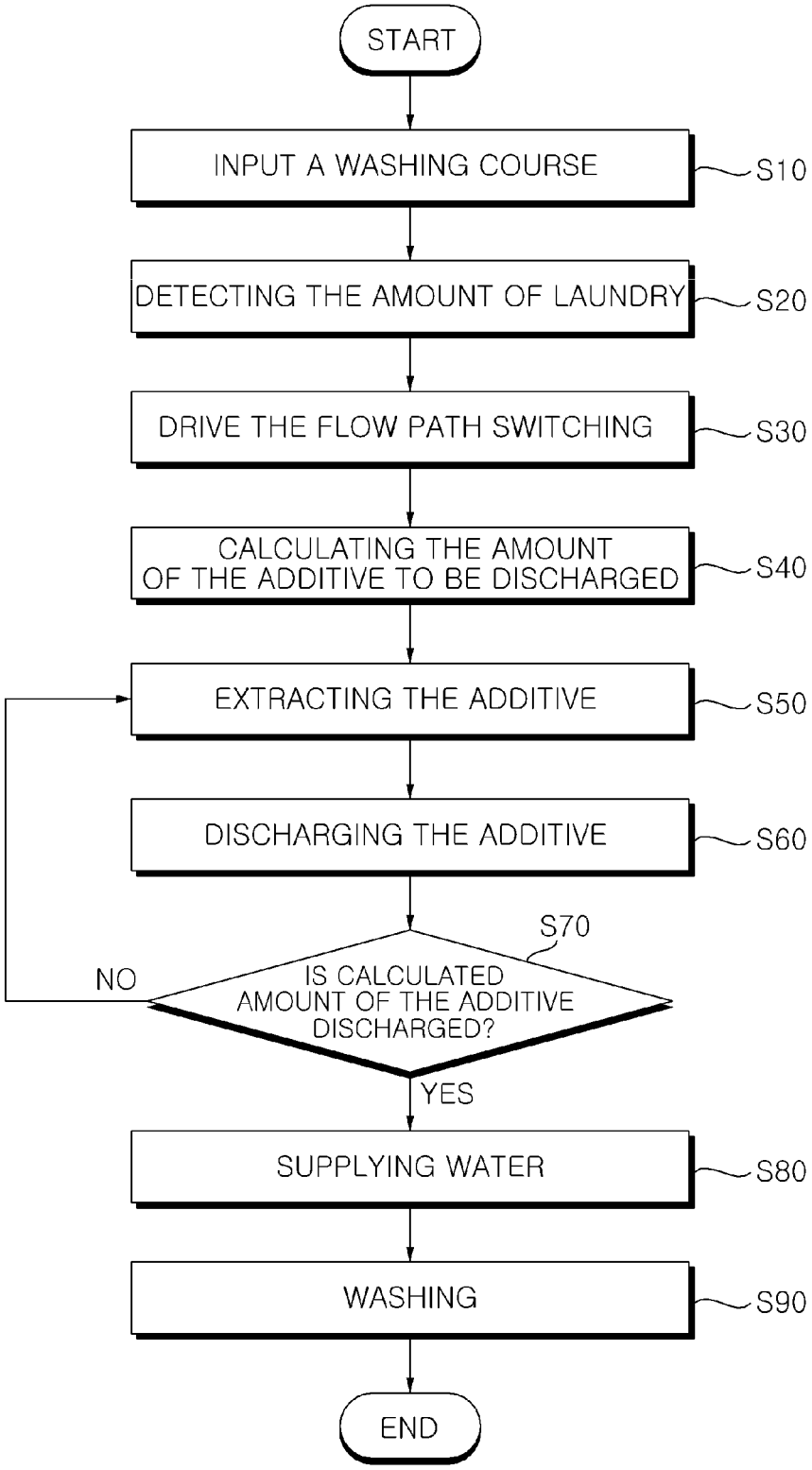
FIG. 20 is a flowchart illustrating an example control method of a washing machine according to an implementation of the present disclosure.

Hereinafter, a control method of a washing machine according to an implementation of the present disclosure will be described with reference to FIG. 20.

The control method of the washing machine according to an implementation of the present disclosure includes a step S10 of receiving a washing course through the input unit 5, a step S30 of driving the flow path switching valve to communicate the pump 500 with the check valve assembly 400*a* connected to the cartridge containing the preset additive according to the input washing course, by the controller 3, a step S50 of extracting the additive from the cartridge to the space, by the pump, and a step S60 of discharging the additive from the space by the pump.

In addition, it may include, before the step S50 of extracting the additive, a step S20 of detecting the amount of laundry accommodated in the washing machine, and after a step S60 of discharging the additive, a step S80 of supplying water to the outlet pipe 800 to dilute and supply the discharged additive to the tub 31, by the water supply valve 830.

In addition, it may further include, after the step S20 of detecting the amount of laundry and before the step S50 of extracting the additive, a step S40 of calculating the amount of the additive to be discharged according to the input washing course and the detected amount of laundry, and after the step S60 of discharging the additive, a step S70 of determining whether the additive is discharged as much as the calculated amount of the additive. The step S50 of extracting the additive and the step S60 of discharging the additive may be repeatedly performed until the calculated amount of additive is discharged.

When the washing machine is turned on, the controller 3 may receive a washing course from the user through the input unit 5 (S10).

When the washing course is input, the controller 3 may detect the amount of laundry accommodated in the drum through the current value obtained by rotating a laundry motor (S20). The control method for detecting laundry is a well known technology, and detailed description thereof will be omitted.

The controller 3 drives the flow path switching valve 600 to communicate the pump 500 with the check valve assembly 400*a* connected to the cartridge containing preset additive according to the input washing course (S30). The memory 4 stores information on additive to be added according to the washing course, and the controller can select additive to be added according to the input washing course. The type of additive contained in the cartridge can be determined by analyzing the current input through the electrode sensor 300 and comparing it with data for each additive stored in the memory 4.

After communicates the pump 500 with the check valve assembly 400*a*, the controller 3 may calculate the amount of the additive to be discharged according to the input washing course and the detected laundry amount (S40). Unlike this, after detecting the amount of laundry (S20), the controller 3 may calculate the amount of the additive to be discharged (S40), and then drive the flow path switching valve 600 (S30). Alternatively, the driving (S30) of the flow path switching valve 600 and the calculation (S40) of the amount of additive to be discharged may be performed simultaneously.

After calculating the amount of the additive to be discharged (S40), the controller 3 moves the piston 580 rearward to extract the additive contained in the cartridge 200*a* into the second space S2 (S50). When the piston 580 moves rearward in the cylinder 590, the pressure of the space S2 formed in the first check valve housing 410 is lowered through the flow path 700*a* communicating with the cylinder 590, the flow path switching valve 600, and the cylinder 590 of the inlet channel 700, the first check valve 420 opens the first discharge hole 421, and the additive contained in the cartridge 200*a* is extracted to the space S2. The second check valve 470 closes the second discharge hole 471 because the pressure of the space S2 formed in the first check valve housing 410 is lower than the pressure of the space formed by the second check valve housing 460, and the extracted additive is temporarily stored in a space formed in the first check valve housing 410.

After extracting the additive, the controller 3 moves the piston 580 forward, so that the additive temporarily stored in the space S2 of the first check valve housing 410 is discharged to the space and/or the outlet pipe 800 of the second check valve housing 460 (S60). When the piston 580 moves forward in the cylinder 590, the pressure of the space S2 formed in the first check valve housing 410 increases through the flow path 700*a* communicating with the cylinder 590, the flow path switching valve 600, and the cylinder 590 of the inlet channel 700, the second check valve 470 opens the second discharge hole 471, the temporarily stored additive is discharged to the space and/or the outlet pipe 800 of the second check valve housing 460. The pressure of the space S2 formed in the first check valve housing 410 is higher than the pressure of the space S1 formed in the docking pipe 440, so that the first check valve 420 closes the first discharge hole 421. Accordingly, the backflow of the additive temporarily stored in the space S2 formed in the first check valve housing 410 toward the cartridge is prevented.

The controller 3 repeats the extracting (S50) and discharging (S60) of the additive until the discharged amount of the additive reaches the calculated amount of the additive (S70).

For example, when the calculated amount of the additive is 100 ml, and the volume of the piston 580 reciprocating within the cylinder 590 is 10 ml, the controller 3 reciprocates the piston 580 ten times.

When the additive is discharged as much as the calculated amount, the controller 3 opens the water supply valve 830 to supply water from an external water source to the outlet pipe 800 (S80).

As described above, the water supply valve 830 may be connected to the water supply port 820*b* provided in the outlet pipe 800 to directly supply water to the outlet pipe, or may be connected to the water supply port 615 provided in the flow path switching valve 600 to supply water to the outlet pipe 800 through the flow path switching valve 600, the inlet channel and the check valve assembly 400.

Thereafter, the input washing course is performed (S100).

According to the washing machine of the present disclosure, one or more of the following effects may be achieved.

First, a plurality of cartridges are respectively connected to a plurality of flow paths provided in the inlet channel through a plurality of check valve assemblies, and the pump and any one of the plurality of flow paths are selectively communicated by the flow path switching valve, so that various liquid additives stored in a plurality of cartridges can be supplied by a single pump.

Second, since the additive contained in the cartridge is extracted into the space formed in the check valve assembly due to the pressure change by the pump, there may be little variation between the amount of the additive to be added and the amount of the additive actually added.

Third, a check valve assembly that controls the extracting of the additive and an inlet channel for transmitting a pressure change to the check valve assembly may be included between the cartridge containing the additive and the pump to extract the additive through a pressure change, thereby preventing the liquid additive from directly contacting the pump, and preventing the mixing of other types of liquid additive.

Although implementations have been described with reference to a number of illustrative implementations thereof, it should be understood that numerous other modifications and implementations can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing machine comprising:

a tub configured to receive water;

a drum rotatably provided in the tub and configured to accommodate laundry therein; and a detergent supply device configured to supply an additive to the tub, wherein the detergent supply device comprises:

a plurality of cartridges configured to receive the additive, a plurality of check valve assemblies connected to the plurality of cartridges, a pump connected to the plurality of check valve assemblies, and an inlet channel connecting the plurality of check valve assemblies to the pump, wherein each of the plurality of check valve assemblies comprises:

a check valve housing connected to the plurality of cartridges and the inlet channel and providing a space that receives a pressure generated by the pump through the inlet channel, a first check valve disposed between an internal space of the plurality of cartridges and the space of the check valve housing, and a second check valve disposed between the space of the check valve housing and an outside of the check valve housing, wherein the space of the check valve housing is provided between the first check valve and the second check valve.

2. The washing machine of claim 1, wherein the pump comprises a cylinder and a piston that is configured to reciprocate within the cylinder.

3. The washing machine of claim 2, wherein the piston is configured to reciprocate within the cylinder along a direction parallel to a direction in which the plurality of cartridges are arranged.

4. The washing machine of claim 2, wherein the pump comprises a motor that is configured provide power to the piston, and wherein the motor includes a drive shaft that is oriented parallel to a direction along which the piston reciprocates within the cylinder.

5. The washing machine of claim 2, wherein the detergent supply device comprises:

a plurality of check valve connection pipes respectively connected to the plurality of check valve assemblies; and an outlet pipe that is configured to guide the additive extracted from the plurality of cartridges toward the tub.

6. The washing machine of claim 2, wherein the detergent supply device further comprises a flow path switching valve connecting the pump to any one of a plurality of flow paths of the inlet channel, and wherein the flow path switching valve is configured to selectively establish fluid communication between the cylinder and any one of the plurality of flow paths of the inlet channel.

7. The washing machine of claim 6, wherein the flow path switching valve comprises:

a first housing that is connected to the cylinder;

a second housing that has a plurality of inlet connection ports respectively coupled to the plurality of flow paths of the inlet channel, that defines a plurality of flow path connection holes respectively in fluid communication with the plurality of inlet connection ports, and that is coupled with the first housing;

a disk that is rotatably disposed in a space defined by the first housing and the second housing; and a spring valve provided at the disk and configured to selectively open and close at least a portion of the plurality of flow path connection holes.

8. The washing machine of claim 7, wherein a number of the spring valve is less than a number of the plurality of flow path connection holes.

9. The washing machine of claim 7, further comprising a controller configured to control operations of the detergent supply device, wherein the flow path switching valve comprises:

a flow path switching motor that is configured to rotate the disk, a a shaft that is configured to transmit a rotational force of the flow path switching motor to the disk, a micro switch that is configured to input a rotational position of the disk to the controller, and a plane cam that rotates together with the shaft and is configured to and open and close a current path flowing through the micro switch.

10. The washing machine of claim 6, wherein the plurality of check valve assemblies comprise a first check valve housing that defines the space configured to receive the additive extracted from the plurality of cartridges.

11. The washing machine of claim 10, wherein the first check valve housing includes an inlet connection portion that is coupled to any one flow path of the plurality of flow paths of the inlet channel and defines a hole that is in fluid communication with the any one flow path.

12. The washing machine of claim 11, wherein a first discharge hole connected to a first cartridge among the plurality of cartridges is defined in the first check valve housing, and wherein the first check valve is configured to open and close the first discharge hole to thereby control the extracting of the additive from the first cartridge to the space in the first check valve housing.

13. The washing machine of claim 12, wherein the detergent supply device comprises:

a plurality of check valve connection pipes respectively connected to the plurality of check valve assemblies; and an outlet pipe that is configured to guide the additive extracted from the plurality of cartridges toward the tub, wherein the plurality of check valve assemblies comprise:

a second check valve housing that defines a second discharge hole in fluid communication with the space of the first check valve housing and that is connected to the check valve connection pipe, and wherein the second check valve is configured to open and close the second discharge hole and to control the extracting of the additive from the space of the first check valve housing into the second check valve housing.

14. The washing machine of claim 13, wherein the first check valve is located in the first check valve housing and is configured to open and close the first discharge hole, and wherein the second check valve is located in the second check valve housing and is configured to open and close the second discharge hole.

15. The washing machine of claim 13, wherein, based on the piston moving within the cylinder in a forward direction toward an inlet channel side, the first check valve is configured to close the first discharge hole and the second check valve is configured to open the second discharge hole, and wherein, based on the piston moving within the cylinder in a rearward direction to an opposite side of the inlet channel, the first check valve is configured to open the first discharge hole and the second check valve is configured to close the second discharge hole.

* * * * *